US008371356B2

(12) United States Patent
Manser

(10) Patent No.: US 8,371,356 B2
(45) Date of Patent: Feb. 12, 2013

(54) GARAGE DOOR APPARATUS WITH FOLDING DOOR PANELS

(76) Inventor: Gary R. Manser, Elmira (CA)

( * ) Notice: Subject to any disclaimer, the term of this patent is extended or adjusted under 35 U.S.C. 154(b) by 542 days.

(21) Appl. No.: 12/546,766

(22) Filed: Aug. 25, 2009

(65) Prior Publication Data

US 2010/0050529 A1 Mar. 4, 2010

Related U.S. Application Data

(60) Provisional application No. 61/091,762, filed on Aug. 26, 2008.

(51) Int. Cl.
*E05D 15/00* (2006.01)

(52) U.S. Cl. ..... 160/201; 160/133; 160/209

(58) Field of Classification Search ..... 160/133, 160/201, 209
See application file for complete search history.

(56) References Cited

U.S. PATENT DOCUMENTS

| | | | | |
|---|---|---|---|---|
| 1,352,656 | A | 9/1920 | Cahill | |
| 1,426,170 | A | 8/1922 | Frantz | |
| 1,437,205 | A | 11/1922 | Sheffield | |
| 1,720,850 | A * | 7/1929 | Negrini | 160/133 |
| 1,876,750 | A | 9/1932 | Reed | |
| 2,349,702 | A | 5/1944 | Campion | |
| 2,390,116 | A * | 12/1945 | Michelman | 160/133 |
| 3,224,492 | A | 12/1965 | Houk | |
| 3,359,594 | A | 12/1967 | Pastoor | |
| 3,640,332 | A * | 2/1972 | Luby et al. | 160/133 |
| 3,672,492 | A * | 6/1972 | Sherr | 206/321 |
| 4,432,406 | A * | 2/1984 | Belanger et al. | 160/199 |
| 4,460,030 | A | 7/1984 | Tsunemura et al. | |
| 4,519,434 | A * | 5/1985 | Forquer | 160/133 |
| 4,524,814 | A | 6/1985 | Deziel | |
| 4,725,000 | A | 2/1988 | Deziel | |
| 5,205,336 | A | 4/1993 | Munekata et al. | |
| 5,265,663 | A | 11/1993 | Munekata et al. | |
| 5,284,199 | A | 2/1994 | Finch et al. | |
| 5,934,352 | A * | 8/1999 | Morgan | 160/201 |
| 6,041,843 | A * | 3/2000 | Mullet | 160/36 |
| 6,123,139 | A | 9/2000 | Kalempa et al. | |
| 6,453,972 | B1 * | 9/2002 | Sher et al. | 160/133 |
| 6,684,932 | B2 | 2/2004 | Olofsson | |
| 7,089,989 | B2 | 8/2006 | Pfender | |
| 7,451,799 | B2 * | 11/2008 | Sanchez | 160/133 |

(Continued)

*Primary Examiner* — Katherine W Mitchell
*Assistant Examiner* — Johnnie A Shablack
(74) *Attorney, Agent, or Firm* — Bereskin & Parr LLP

(57) ABSTRACT

A garage door apparatus includes a frame for mounting above an opening, the frame comprising a pair of spaced transverse frame members, a shaft rotatably coupled to the transverse frame members and extending along a longitudinal axis of rotation between the transverse frame members, a pair of spaced winding frames rigidly coupled to the shaft between the spaced transverse frame members, each of the winding frames having a plurality of side edges, a driver couplable to the shaft for rotating the shaft with respect to the transverse frame members, and a plurality of door panels hingedly coupled together and linked to the winding frames, each of the door panels being of equal width and having a longitudinal panel length, the plurality of door panels including at least one inner door panel and at least one outer door panel, wherein the winding frames are spaced apart a predetermined distance that is less than the longitudinal panel length of the plurality of door panels, such that when the winding frames are rotated by the driver about the axis of rotation, the side edges of the winding frames progressively engage each of the door panels, thereby moving the door panels between an extended position wherein the door panels obstruct the opening, and a retracted position wherein each door panel is wound onto one of the side edges of the winding frames, the opening is at least partially unobstructed, and the at least one outer door panel overlaps with the at least one inner door panel.

15 Claims, 20 Drawing Sheets

U.S. PATENT DOCUMENTS 7,484,332 B2 * 2/2009 Hormann et al. ..... 49/322
7,784,520 B2 * 8/2010 Paulson ..... 160/201
7,798,198 B2 * 9/2010 Rejc et al. ..... 160/133
8,091,607 B2 * 1/2012 Aquilina ..... 160/201

* cited by examiner

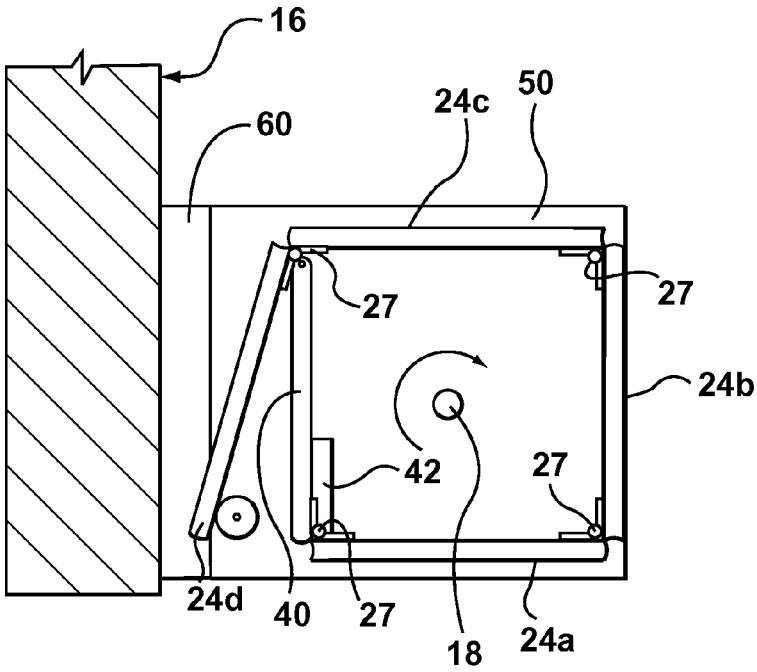
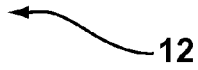
FIG. 5
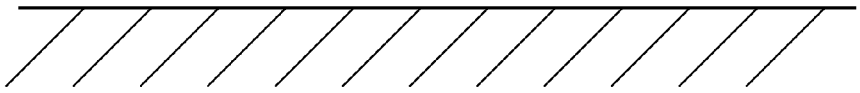

GARAGE DOOR APPARATUS WITH FOLDING DOOR PANELS

RELATED APPLICATIONS

This application claims the benefit of U.S. Provisional Patent Application Ser. No. 61/091,762 filed on Aug. 26, 2008, the entire contents of which are hereby incorporated by reference.

TECHNICAL FIELD

The present invention relates to apparatus for garage doors.

BACKGROUND

Some prior art garage doors for homes and other buildings include door panels that are hinged together and which are configured to move between a closed position, wherein the door panels obstruct an opening in the building, and a raised position wherein the door panels are stored above the door opening so that the opening is unobstructed. In many garage doors, when in the raised position the door panels are positioned near the ceiling, with each door panel generally lying in the same horizontal plane. This configuration tends to obstruct a large area of the ceiling and requires a large framework of tracks and straps. This is undesirable as it makes the ceiling space unusable for storage or other uses.

Attempts have been made to overcome this problem. For example, U.S. Pat. No. 7,089,989 (Pfender) discloses a door with panels that fold together in an accordion-type configuration, wherein the panels stack together when the door is in the raised position. However, this arrangement tends to be complicated, expensive to manufacture, and often requires special hinging arrangements to withstand the forces associated with panel movement between the closed position and the open position.

Accordingly, there is a need for an improved garage door apparatus that overcomes at least some of the above noted disadvantages.

SUMMARY

According to one aspect of the invention, there is provided a garage door apparatus comprising a frame for mounting above an opening, the frame including a pair of spaced transverse frame members, a shaft rotatably coupled to the transverse frame members and extending along a longitudinal axis of rotation between the transverse frame members, a pair of spaced winding frames rigidly coupled to the shaft between the spaced transverse frame members, each of the winding frames having a plurality of side edges, a driver couplable to the shaft for rotating the shaft with respect to the transverse frame members, and at least five door panels hingedly coupled together and linked to the winding frames, each of the door panels being of equal width and having a longitudinal panel length, the plurality of door panels including at least one inner door panel and at least one outer door panel, wherein the winding frames are spaced apart a predetermined distance that is less than the longitudinal panel length of the plurality of door panels, such that when the winding frames are rotated by the driver about the axis of rotation, the side edges of the winding frames progressively engage each of the door panels, thereby moving the door panels between an extended position wherein the door panels obstruct the opening, and a retracted position wherein each door panel is wound onto one of the side edges of the winding frames, the opening is at least partially unobstructed, and the at least one outer door panel overlaps with the at least one inner door panel.

The inner door panels may be hingedly coupled together by inner hinges, and the outer door panels may be hingedly coupled together by outer hinges, with at least one of the inner hinges of the inner door panels having a common pivot axis with one of the outer hinges of the corresponding overlapping outer door panel when the door panels are in the retracted position.

The door panels may each have opposing panel side edges, and the inner hinges may be provided on the panel side edges of the inner door panels, and the outer hinges may be provided on the panel side edges of the outer door panels.

The outer hinges may be longitudinally spaced from the inner hinges to inhibit interference between the inner hinges and the outer hinges when the door panels move between the extended position and the retracted position.

The apparatus may further comprise a pair of guide channels configured to be mounted adjacent vertical sides of the opening for guiding the door panels as they move between the extended position and the retracted position.

The apparatus may further comprise rollers mounted within the channel guides, the roller sized and shaped for engaging with panel side edges as the door panels move between the extended position and the retracted position.

The door panels may be hingedly coupled together by hinges provided on the panel side edges, the hinges and panel side edges having grooves therein, and the rollers may be transversely mounted within the channel guides and configured to engage with the grooves as the door panels move between the extended position and the retracted position.

According to another embodiment of the invention, there is provided a garage door apparatus comprising a frame for mounting above an opening, the frame comprising a pair of spaced transverse frame members, a shaft rotatably coupled to the transverse frame members and extending along a longitudinal axis of rotation between the transverse frame members, a pair of spaced winding frames rigidly coupled to the shaft between the spaced transverse frame members, each of the winding frames having a plurality of side edges, a driver couplable to the shaft for rotating the shaft with respect to the transverse frame members, a plurality of elongate door panels hingedly coupled together and linked to the winding frames, each of the door panels being of equal width and having a longitudinal panel length, and each of the door panels having opposing panel side edges and hinges provided on the panel side edges for coupling with hinges on an adjacent door panel, each of the hinges and panel side edges having a groove therein, and a pair of guide channel assemblies for mounting adjacent opposite vertical sides of the opening, each guide channel assembly including rollers transversely mounted therein, the rollers sized and shaped for engaging with the grooves in the hinges and side edges as the door panels move between an extended position and a retracted position, and wherein the winding frames are spaced apart a predetermined distance that is less than the panel length of the plurality of door panels, such that when the winding frames are rotated by the driver about the axis of rotation, the side edges of the winding frames progressively engage each of the door panels thereby moving the door panels between the extended position wherein the door panels obstruct the opening, and the retracted position wherein each door panel is wound onto one of the side edges of the winding frames and the opening is at least partially unobstructed.

The door panels may further comprise a plurality of inner door panels and at least one outer door panel, the hinges may further comprise inner hinges on the inner door panels and outer hinges on the outer door panels, and when the door panels are in the retracted position, each outer door panel may overlap with one inner door panel, and at least one of the inner hinges of the inner door panels have a common pivot axis with one of the outer hinges of the corresponding overlapping outer door panel when the door panels are in the retracted position.

The outer hinges may be longitudinally spaced from the inner hinges to inhibit interference between the inner hinges and the outer hinges as the door panels move between the extended position and the retracted position.

According to yet another aspect of the invention, there is provided a garage door apparatus comprising a frame for mounting above an opening, the frame comprising a pair of spaced transverse frame members and at least one longitudinal cross member extending between the transverse frame members, a shaft rotatably coupled to the transverse frame members and extending along a longitudinal axis of rotation between the transverse frame members, a pair of spaced winding frames rigidly coupled to the shaft between the spaced transverse frame members, each of the winding frames having a plurality of side edges, a driver couplable to the shaft for rotating the shaft with respect to the transverse frame members, and a plurality of elongate door panels hingedly coupled together, each of the door panels having a longitudinal panel length, the plurality of door panels including a first door panel linked to the winding frames, wherein the winding frames are spaced apart a predetermined distance that is less than the panel length such that when the winding frames are rotated about the axis of rotation, the side edges of the winding frames progressively engage each of the door panels, thereby moving the door panels between an extended position wherein the door panels obstruct the opening, and a retracted position wherein each door panel is wound onto one of the side edges of the winding frames and the opening is at least partially unobstructed.

The plurality of door panels may include at least four door panels of equal width, and each of the winding frames may have a square shape with four side edges.

The apparatus may further comprise a pair of guide channels configured to be mounted along vertical sides adjacent the opening for guiding the door panels as they move between the extended position and the retracted position. Each door panel may further comprise opposing panel side edges, and rollers mounted within the channel guides, the rollers sized and shaped for engaging with the panel side edges as the door panels move between the extended position and the retracted position. The door panels may be hingedly coupled together by hinges provided on the panel side edges, the hinges and panel side edges having grooves therein, and the rollers may be transversely mounted within the channel guides and configured to engage with the grooves as the door panels move between the extended position and the retracted position.

The door panels and frame may be configured so that the door panels form the sides of a transportation container when the door panels are in the retracted state.

In some embodiments, the door panels may comprise a plurality of inner door panels and at least one outer door panel, each door panel having panel side edges, and the door panels may be hingedly coupled together by inner hinges provided on the panel side edges of the inner door panels, and outer hinges provided on the panel side edges of the outer door panels, wherein, when the door panels are in the fully retracted position, each outer door panel overlaps with one inner door panel, with at least one of the inner hinges of the inner door panels having a common pivot axis with an outer hinge of the corresponding overlapping outer door panel. The outer hinges may be longitudinally spaced from the inner hinges to inhibit interference between the inner hinges and the outer hinges when the door panels move between the extended position and the retracted position.

The at least one longitudinal cross members may include a front cross member and a rear cross member.

Each frame member may have a first bracket mounted thereto, each first bracket configured to be engaged with a corresponding second bracket secured to a mounting surface above the opening.

Other aspects and features of the present specification will become apparent to those ordinarily skilled in the art upon review of the following description.

BRIEF DESCRIPTION OF THE DRAWINGS

The drawings included herewith are for illustrating various examples of articles, methods, and apparatuses of the present specification and are not intended to limit the scope of what is taught in any way. In the drawings:

FIG. 5 is schematic side view of the apparatus of FIG. 1 with the door panels retracted;

DETAILED DESCRIPTION

Figure 1:
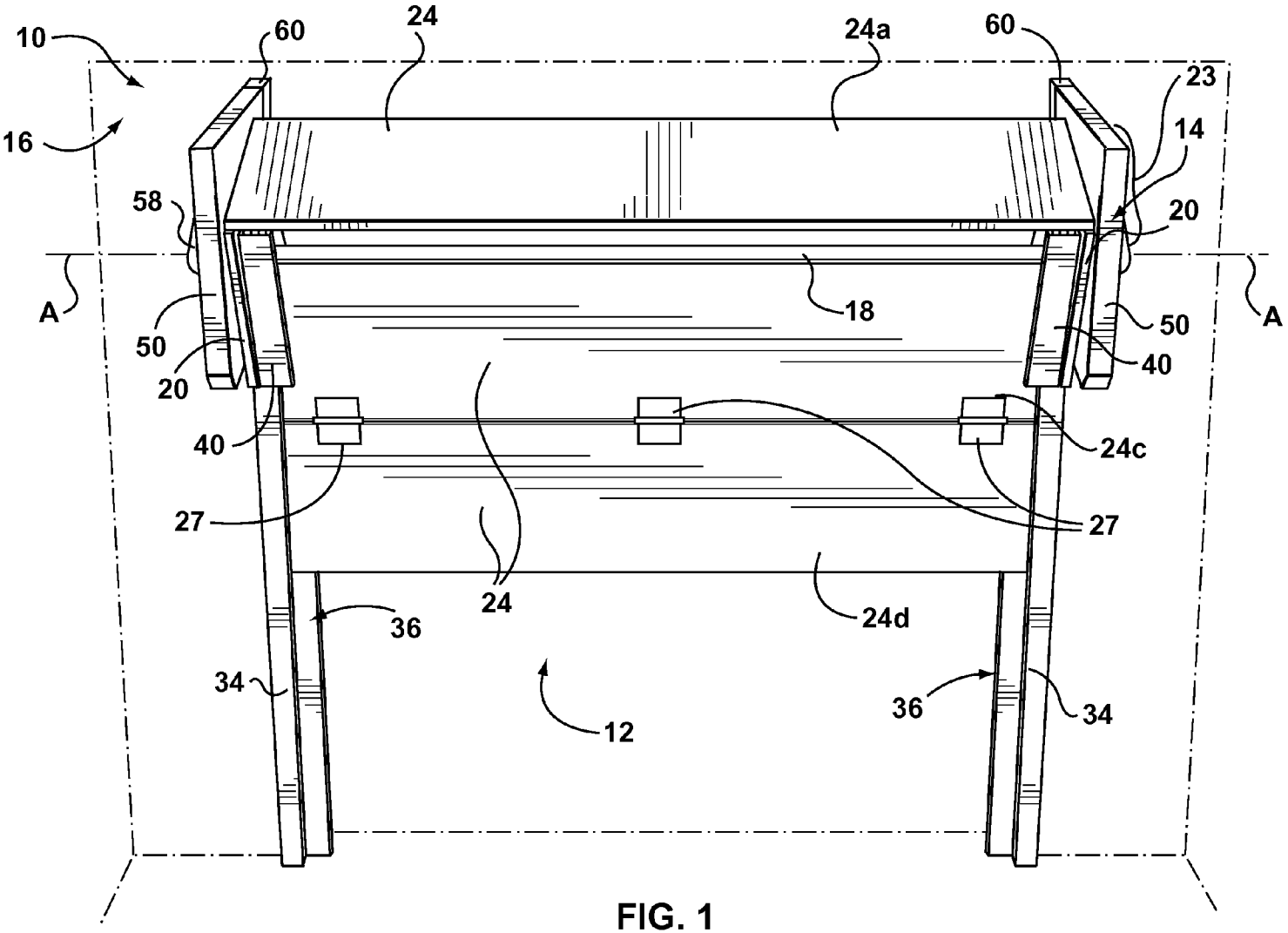
FIG. 1 is a rear perspective view of a garage door apparatus according to one embodiment with the door panels partially retracted.
Figure 2:
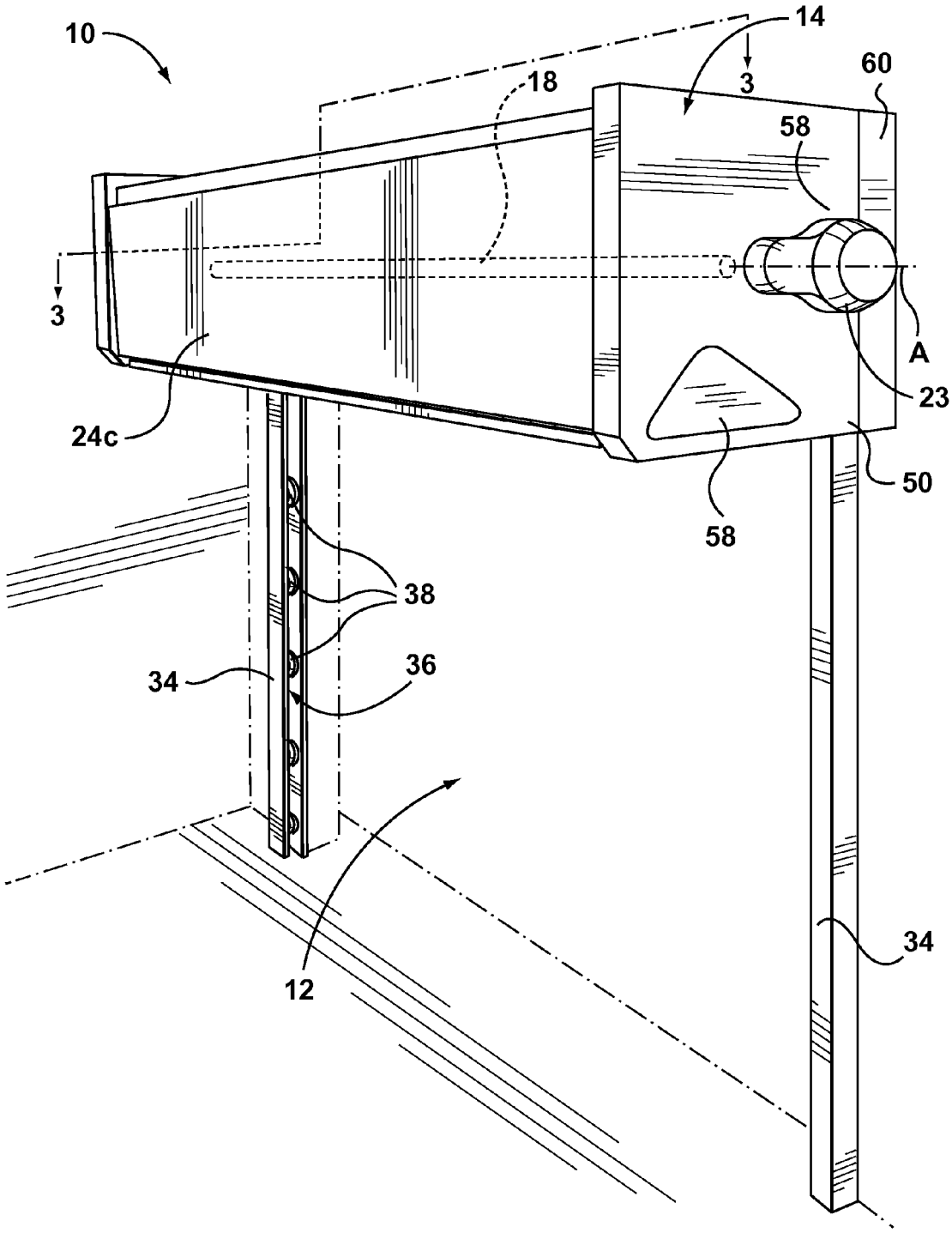
FIG. 2 is a side perspective view of the apparatus of FIG. 1 with the door panels fully retracted.
Figure 3:
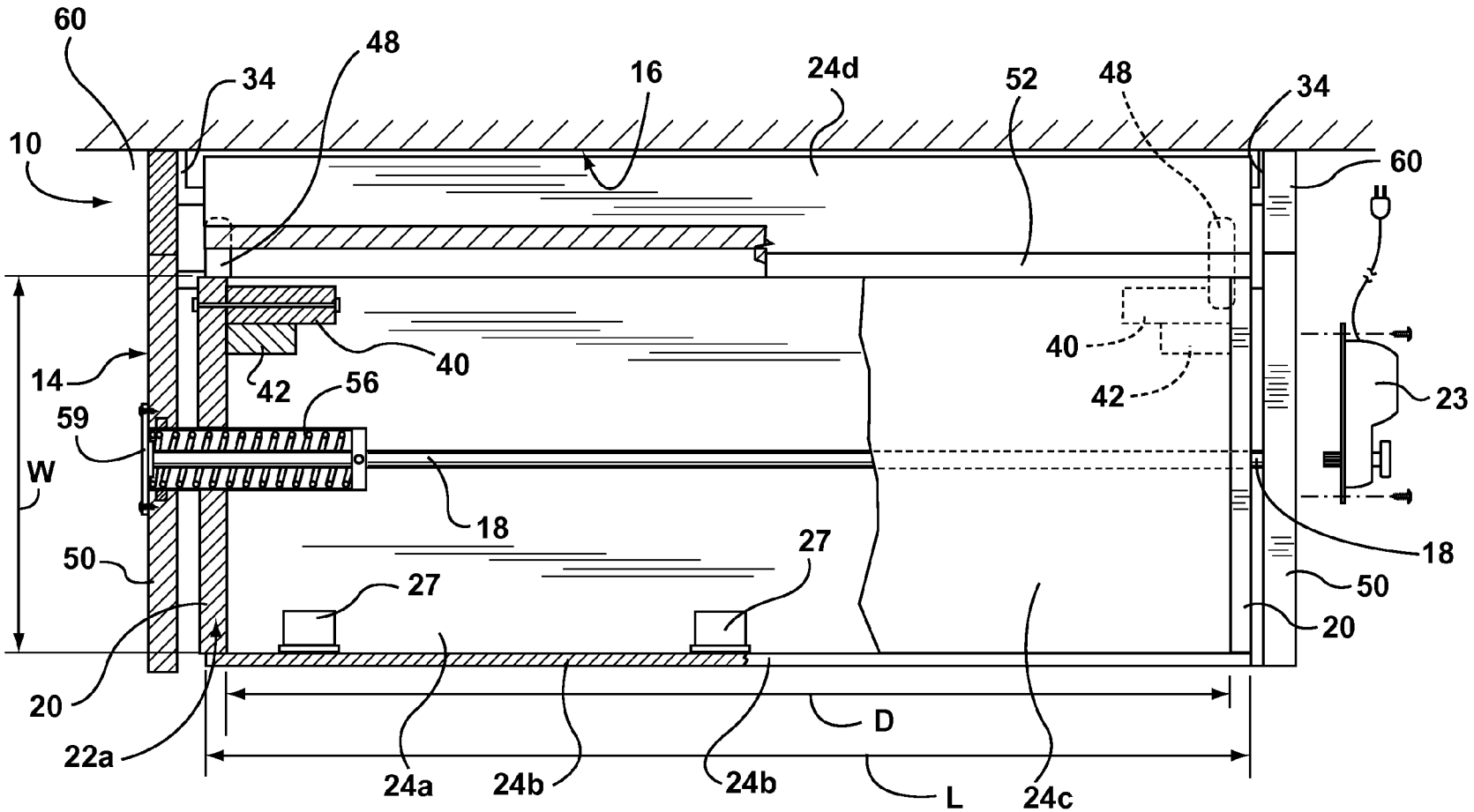
FIG. 3 is a partial cross-sectional plan view of the apparatus of FIG. 2 taken through line 3-3

Referring now generally to FIGS. 1 to 3, illustrated therein is a garage door apparatus 10 according to one embodiment of the invention. The apparatus 10 generally includes a frame 14 having a pair of spaced transverse frame members 50. The apparatus 10 also includes a shaft 18 rotatably coupled to the transverse frame members 50, a pair of spaced winding frames 20 rigidly coupled to the shaft 18 and positioned in between the spaced frame members 50, a driver 23 coupled to the shaft 18 for rotating the shaft 18 and the winding frames 20, and a plurality of elongate door panels 24 hinged together and linked to the spaced winding frames 20.

The frame 14 is mountable above an opening 12 in a wall, such as on a mounting surface 16 above the opening 12 in a wall of a garage. As shown, the frame 14 has a box-like shape. This shape is convenient as it allows the garage door apparatus 10 to be easily transported and delivered to a worksite as a ready-to-install assembly, as will be described in further detail below.

The shaft 18 is rotatably coupled to the transverse frame members 50 such that the shaft 18 may be rotated with respect to the transverse frame members 50, and generally defines a longitudinal axis of rotation A.

Rigidly coupled to the shaft 18, the winding frames 20 are spaced apart a predetermined distance D (as shown in FIG. 3). Each winding frame 20 includes a plurality of side edges 22 that are generally shaped to progressively engage with the door panels 24 as the shaft 18 is rotated, as will be described in further detail below.

Figure 6:
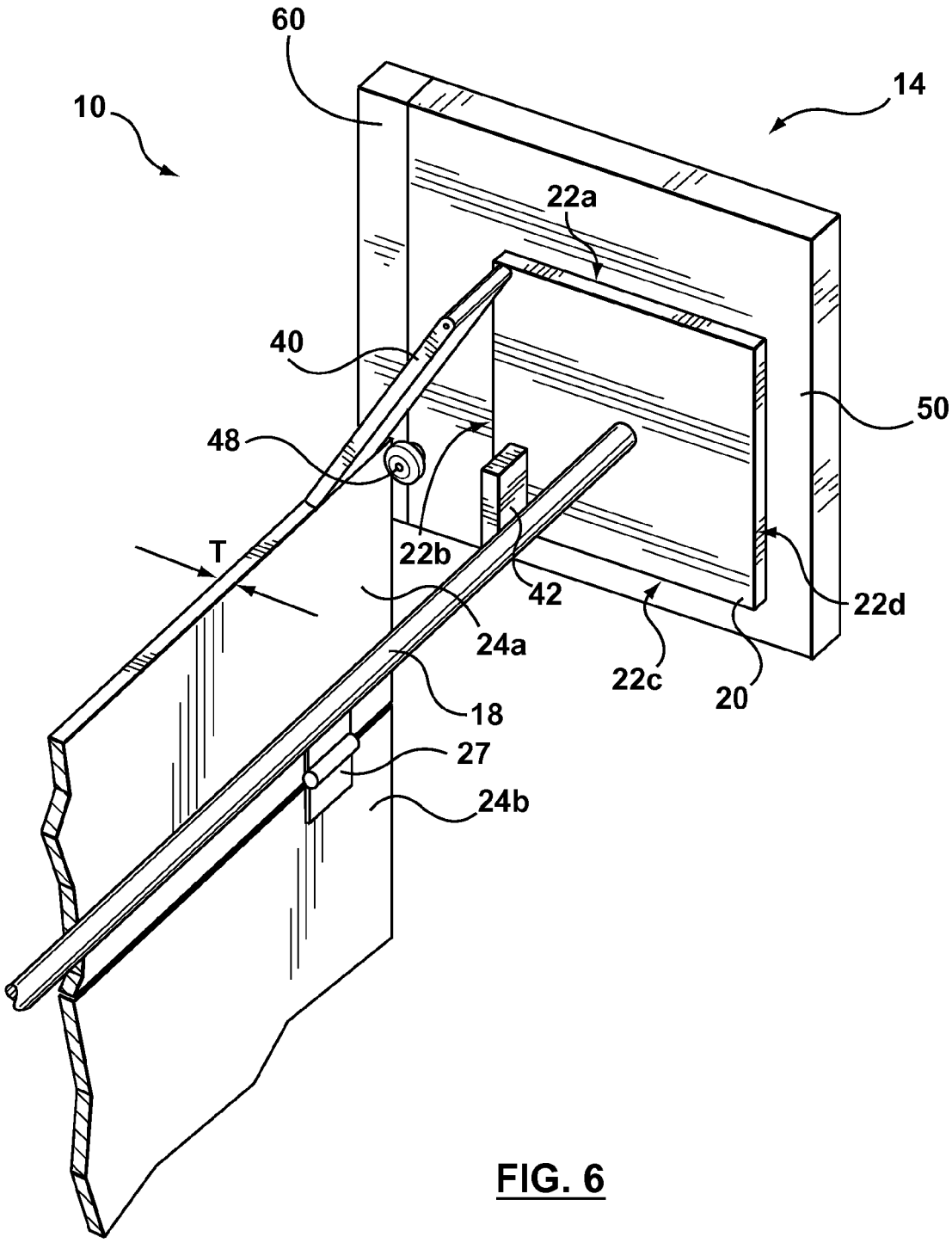
FIG. 6 is a close-up perspective view of a portion of the apparatus of FIG. 1 with the door panels fully extended.

In some embodiments, as shown in FIG. 6 for example, each winding frame 20 may have a rectangular or square shape with four side edges 22. The side edges 22 may include a first side edge 22*a*, a second side edge 22*b*, a third side edge 22*c* and a fourth side edge 22*d*. In other embodiments, each winding frame 20 may have a shape corresponding to another polygon, for example a triangle, a pentagon or hexagon.

As discussed above, the garage door apparatus 10 also includes a driver 23 coupled to the shaft 18. The driver 23 is configured to rotate the shaft 18, which in turn causes the winding frames 20 to rotate about the longitudinal axis of rotation A. The driver 23 may be a motor, for example an electric AC or DC motor. Alternatively, the driver 23 may be a manual cranking apparatus for manually rotating the shaft 18, for example, a hand crank. In other embodiments, the driver 23 may include both an electric motor and a manually operated cranking apparatus.

In some embodiments, the apparatus 10 may include one or more biasing members configured to assist the driver 23 in raising and lowering the door panels 24. For example, as shown in FIG. 3, a coiled spring 56 may be coupled to the shaft 18 and to one of the transverse frame members 50 to counteract the weight of the door panels 24 during rotation of the winding frames 20. The spring 56 may be accessible by a removable spring plate 59 which may be useful to replacing or servicing the spring 56.

The apparatus 10 also includes a plurality of elongate door panels 24 that are movable with respect to the opening 12 to selectively obstruct and unobstruct the opening 12. Each of the door panels 24 has a longitudinal panel length L and a panel width W, as shown in FIG. 3. The panel length L is generally greater than the distance D between the winding frames 20, but less that the distance between the transverse frame members 50. It is generally desirable that each door panel 24 have the same shape and dimensions to enhance the aesthetic appeal of the garage door apparatus 10 when the door panels 24 are in the fully extended position. Accordingly, in some embodiments the panel length L and panel width W are equal for each of the door panels 24. Adjacent door panels 24 are hingedly coupled together via hinges, which may be conventional hinges 27 or other hinges, for example the hinges described in further detail below.

In some embodiments, the apparatus 10 may include four door panels 24, with a first door panel 24*a* (or uppermost door panel), a second door panel 24*b*, a third door panel 24*c* and a fourth door panel 24*d*. For example, the apparatus 10 may include the door panels 24*a*, 24*b*, 24*c*, and 24*d*, shown in FIG. 4 fully unwound from the winding frames 20 (with the opening 12 obstructed), and shown in FIG. 5, fully wound onto the winding frames 20 with the opening 12 unobstructed.

The door panels 24 are linked to the winding frame 20 so that they may be wound onto the winding frames 20. For example, the first door panel 24*a* may be flexibly linked to the winding frames 20 by a link arm 20 or other connector, as shown for example in FIGS. 4 to 6. The link arm 20 may be a rigid link member having a length generally equal to the panel width W and a link thickness Q. Alternatively, the link arm 20 may be a flexible chain or other non-rigid link member.

Figure 7:
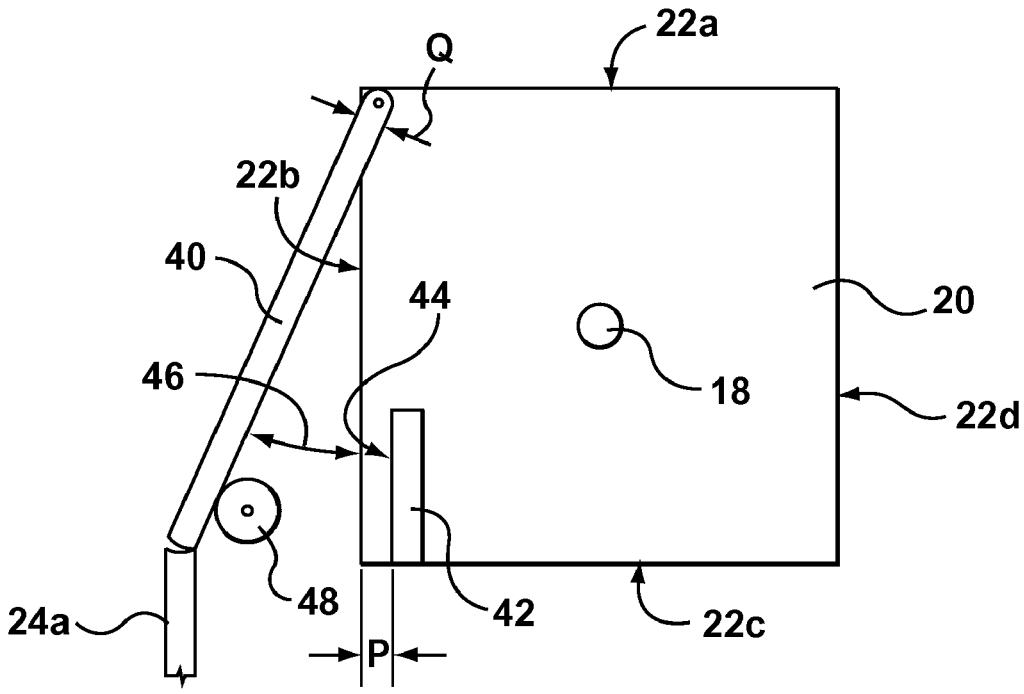
FIG. 7 is a schematic view of the apparatus of FIG. 1 with the door panels fully extended.

In some embodiments, each winding frame 20 may include a link arm flange 42 adjacent each link arm 40 (as shown in FIGS. 6 and 7). Each link arm flange 42 extends generally inwardly from each winding frame 20 (towards the opposite winding frame 20), and has an abutting surface 44 thereon generally facing the link arm 40, the surface 44 being sized and shaped to receive the link arm 40. The flange 42 is offset from one of the side edges 22 of the winding frames 20 (e.g. the second side edge 22*b*) by a distance P generally equal to the thickness Q of the link arms 40. During rotation of the winding frames 20, each link arm 40 may be received on the abutting surface 44 such that the link arm 40 is positioned below the second edge 22*b* and does not interfere with engagement between the door panels 24 and the side edges 22 of the winding frames 20 (e.g. between the fourth door panel 24*d* with the second edge 22*b*).

The garage door apparatus 10 may also include guide wheels 48 or other guide members. The guide wheels 48 or other guide members are configured to bias the link arms 40 and the door panels 24 generally away from the winding frames 20 during rotation of the winding frames 20 such that the door panels 24 and link arms 40 tend not to interfere with the rotation of the winding frames 20. The guide wheels 48 also tend to facilitate proper alignment of the door panels 24 with respect to the opening 12.

The apparatus 10 may also include one or more guide channels 34 configured to be mounted on opposite vertical sides adjacent the opening 12. The guide channels 34 engage with the door panels 24 and tend to the ensure the that the door panels 24 are properly positioned with respect to the opening 12 as the door panels move between the extended (unwound) and retracted positions. In some embodiments, the guide channels 34 include a recessed portion 36, which may be sized and shaped to receive the door panels 24 therein.

In some embodiments, the guide channels 34 may include wheels or rollers 38 mounted in the recessed portion 36 of the guide channels 34 for assisting in guiding the door panels 24. In alternative embodiments, rollers may be provided on the door panels 24 for engaging with corresponding surfaces in the guide channels 34.

Figure 4:
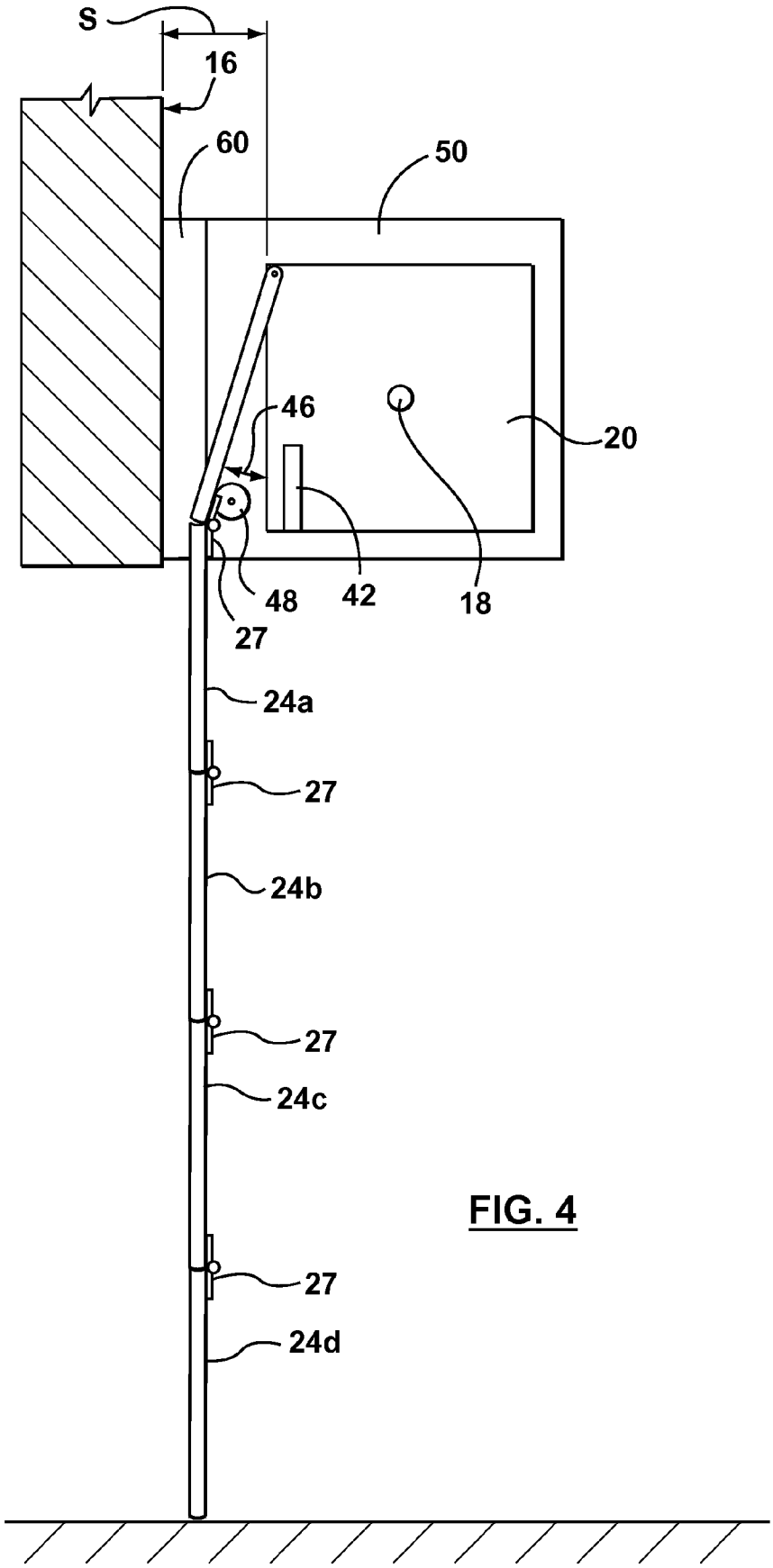
FIG. 4 is a schematic side view of the apparatus of FIG. 1 with the door panels fully extended.

During use of the apparatus 10, the driver 23 may be activated causing the shaft 18 to rotate with respect to the transverse frame members 50. The rotation of the shaft 18 in turn causes the winding frames 20 rotate about the longitudinal axis of rotation A. As this happens, the side edges 22 of the winding frames 20 each progressively engage one of the door panels 24, thereby moving the door panels 24 between the extended position (as shown in FIG. 4) and the retracted position (as shown in FIG. 5). Each door panel 24 is thus wound onto one of the side edges 22 of the winding frames 20.

Figure 8:
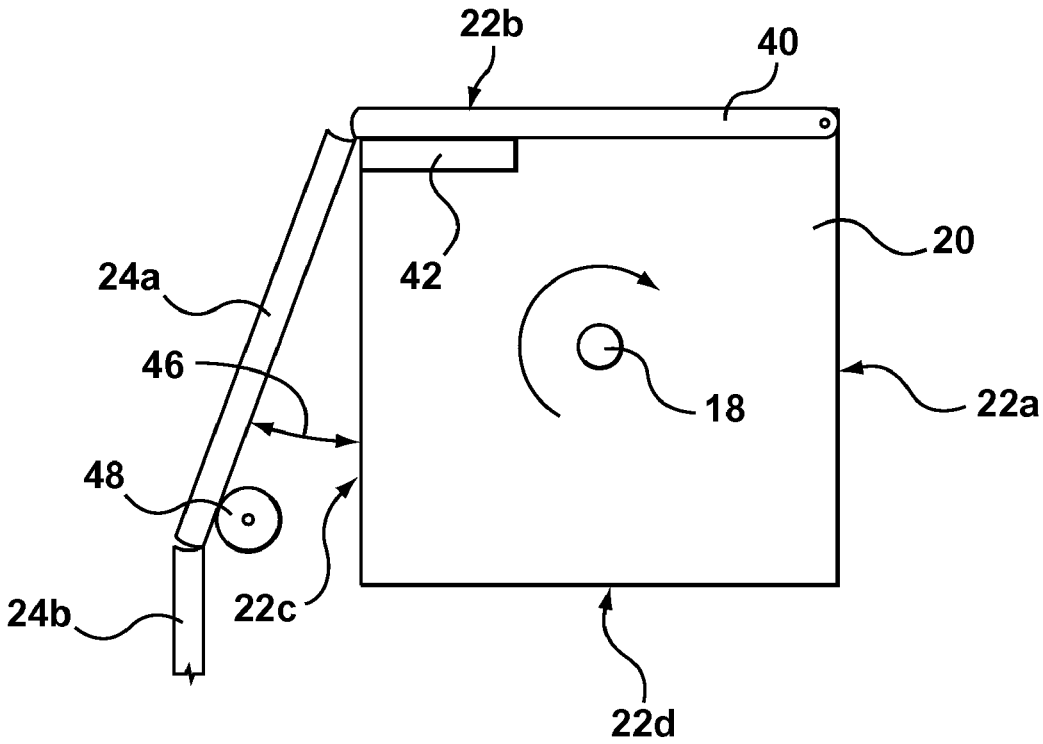
FIG. 8 is a schematic view of the apparatus of FIG. 1 with the door panels wound one quarter turn onto winding frames.

For example, in FIGS. 4 and 7 the door panels 24 are shown in a fully extended position, and the opening 12 is obstructed. To retract the door panels 24 (i.e. to unobstruct the opening), the winding frames 20 are rotated by the driver 23 in a first direction (e.g. clockwise). As shown in FIG. 8, the winding frames 20 may be rotated a ¼ turn clockwise from the fully extended position, with the door panels 24 retracted by a distance equal to the width W of one door panel 24. In this position, the link arm 20 is engaged with the abutting surface 44 of the link arm flange 42, with the outer edge of the link arm 20 generally below the second side edge 22*b*, and the first door panel 24*a* is engaged with the guide wheel 48 (as shown in FIG. 8).

Figure 9:
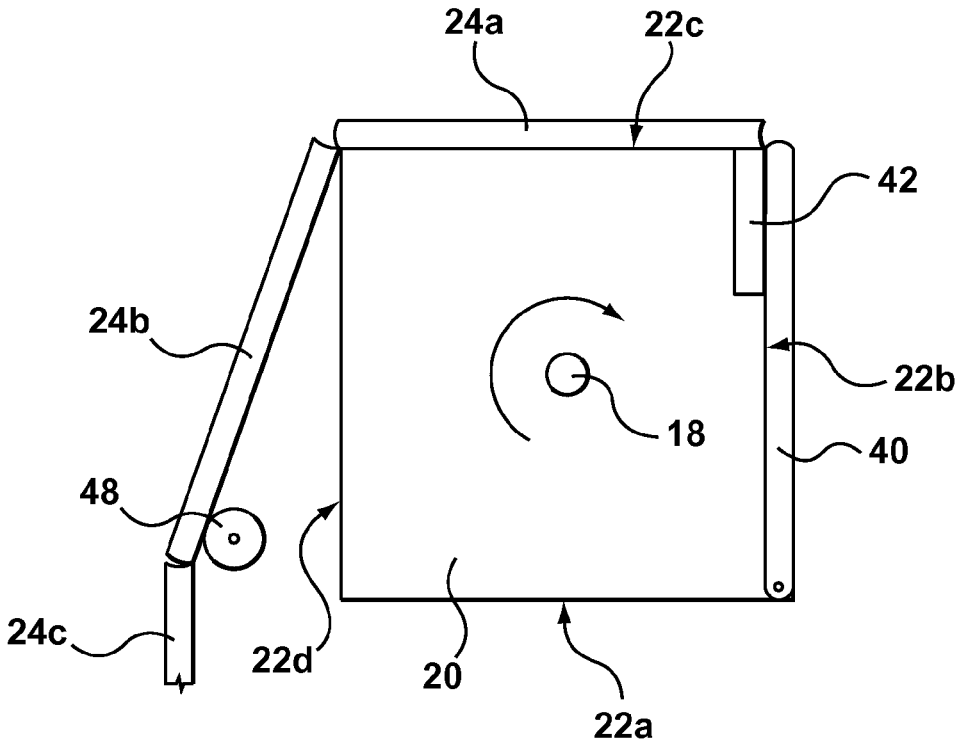
FIG. 9 is a schematic view of the apparatus of FIG. 8 with the door panels wound one half turn onto the winding frames.

As the driver 23 continues to rotate the shaft 18 another ¼ turn clockwise, the winding frames 20 are rotated a ½ turn from the fully extended position, and the door panels 24 are retracted by a distance equal to the width of two door panels 24. In this position, the uppermost or first panel 24*a* is wound onto the third side edge 22*c* of the winding frames, and the second door panel 24*b* is engaged with the guide wheel 48 (as shown in FIG. 9).

Figure 10:
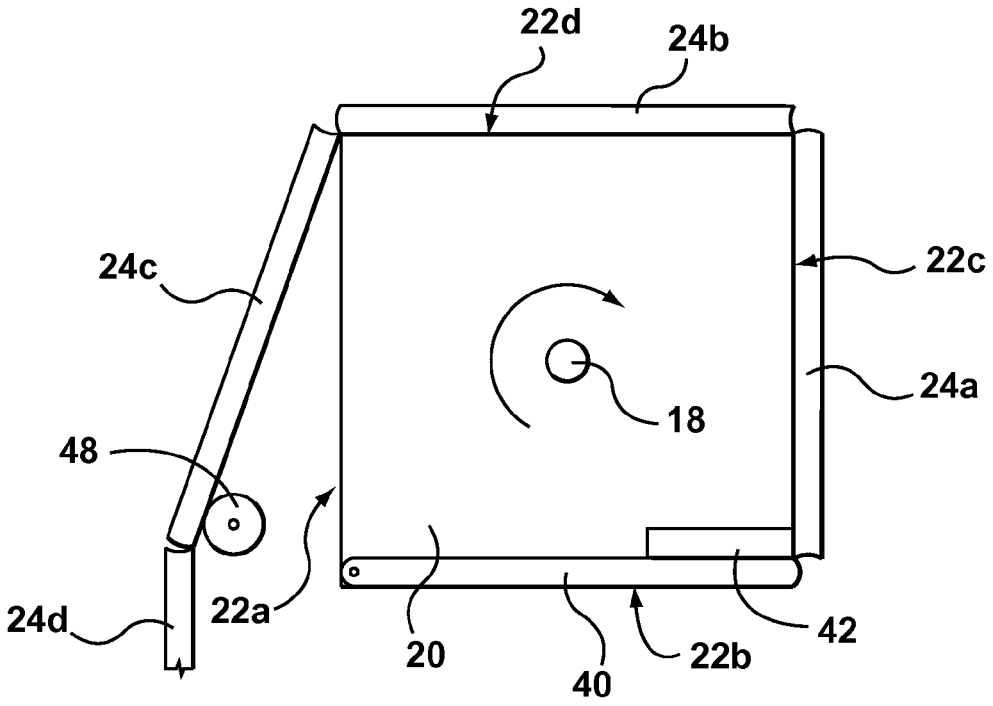
FIG. 10 is a schematic view of the apparatus of FIG. 8 with the door panels wound three quarter turns onto the winding frames.

As the driver 23 continues to rotate the shaft 18 another ¼ turn clockwise, the winding frames 20 are rotated ¾ turns from the fully extended position, and the door panels 24 are retracted by a distance equal to the width of three door panels 24. In this position, the second door panel 24*b* is wound onto the fourth side edge 22*d*, and the third door panel 24*c* is engaged with the guide wheel 48 (as shown in FIG. 10).

Figure 11:
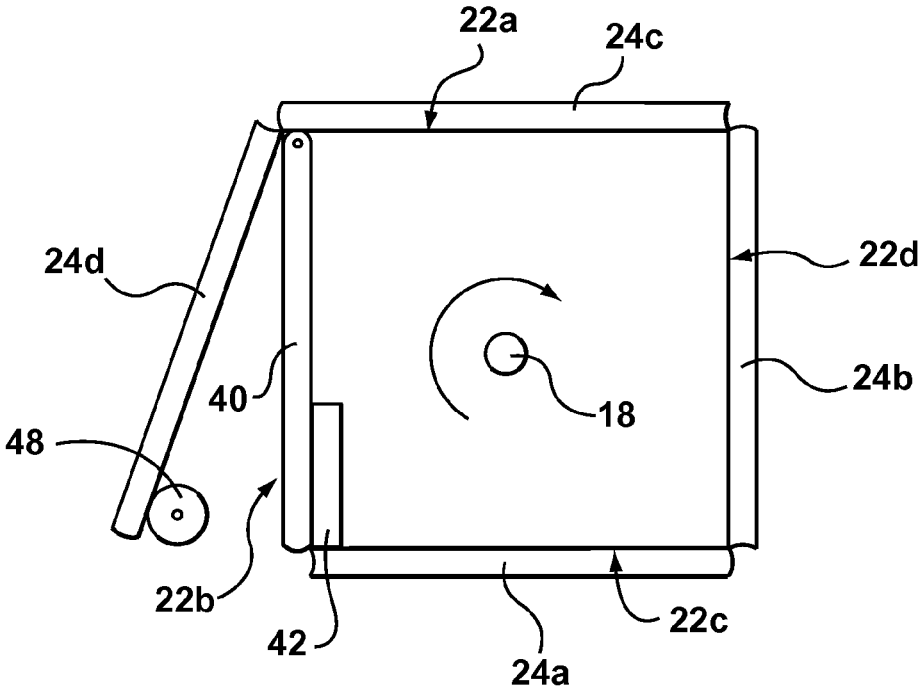
FIG. 11 is a schematic view of the apparatus of FIG. 8 with the door panels wound a full turn onto the winding frames.

As the driver 23 continues to rotate the shaft 18 another ¼ turn clockwise, the winding frames 20 are rotated by a full turn from the fully extended position, and the door panels 24 are retracted by a distance equal to the width of four door panels 24. In this position, the third door panel 24*c* is wound onto the first side edge 22*d*, and the fourth door panel 24*d* is engaged with the guide wheel 48 (as shown in FIGS. 5 and 11). In this position, the opening 12 is generally fully open, and thus objects may be moved through the opening 12. For example, the opening 12 may be used to receive a vehicle in the garage.

To lower the door panels 24 (e.g. to move the door panels 24 from the retracted position to the extended position in order to close the garage door), the driver 13 may be rotated in a second direction opposite the first direction (e.g. counterclockwise in the example shown).

Figure 12:
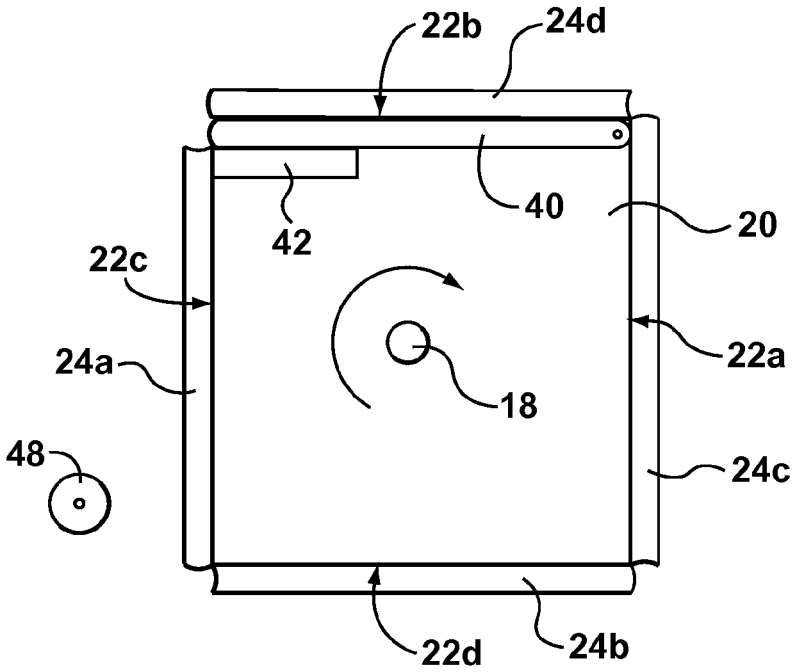
FIG. 12 is a schematic view of the apparatus of FIG. 8 with the door panels wound five quarter turns onto the winding frames.
Figure 13:
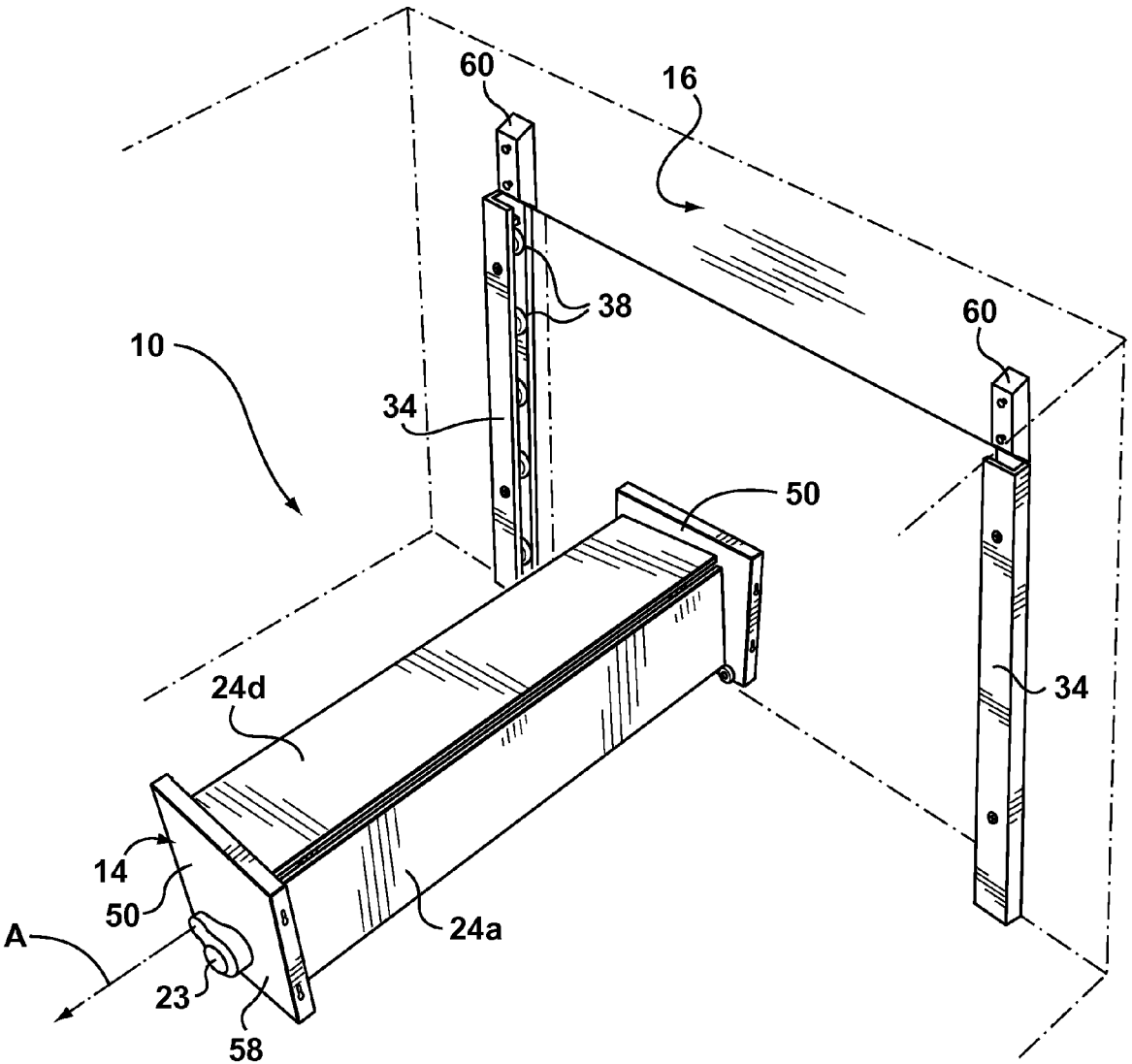
FIG. 13 is a perspective view of the apparatus of FIG. 1 with the frame decoupled from the mounting surface.

In some embodiments, the driver 23 may rotate the winding frames 20 beyond a full turn to completely disengage the door panels 24 from the guide wheels 48. For example, as shown in FIG. 12, the winding frames 20 may be rotated clockwise by 5/4 turns from the fully extended position, fully retracting the door panels 24 onto the winding frames 20. In this position, the fourth door panel 24*d* is wound onto the second side edge 22*b*, and the door panels 24 have been disengaged from the guide wheel 48. This fully-retracted configuration may be useful for removing or installing the frame 14 above the opening 12. For example, as shown in FIG. 13, the garage door apparatus 10 may be delivered to a worksite with the door panels 24 provided in a fully retracted state, allowing for easy delivery and mounting of the apparatus 10 to the mounting surface 16.

Figure 14:
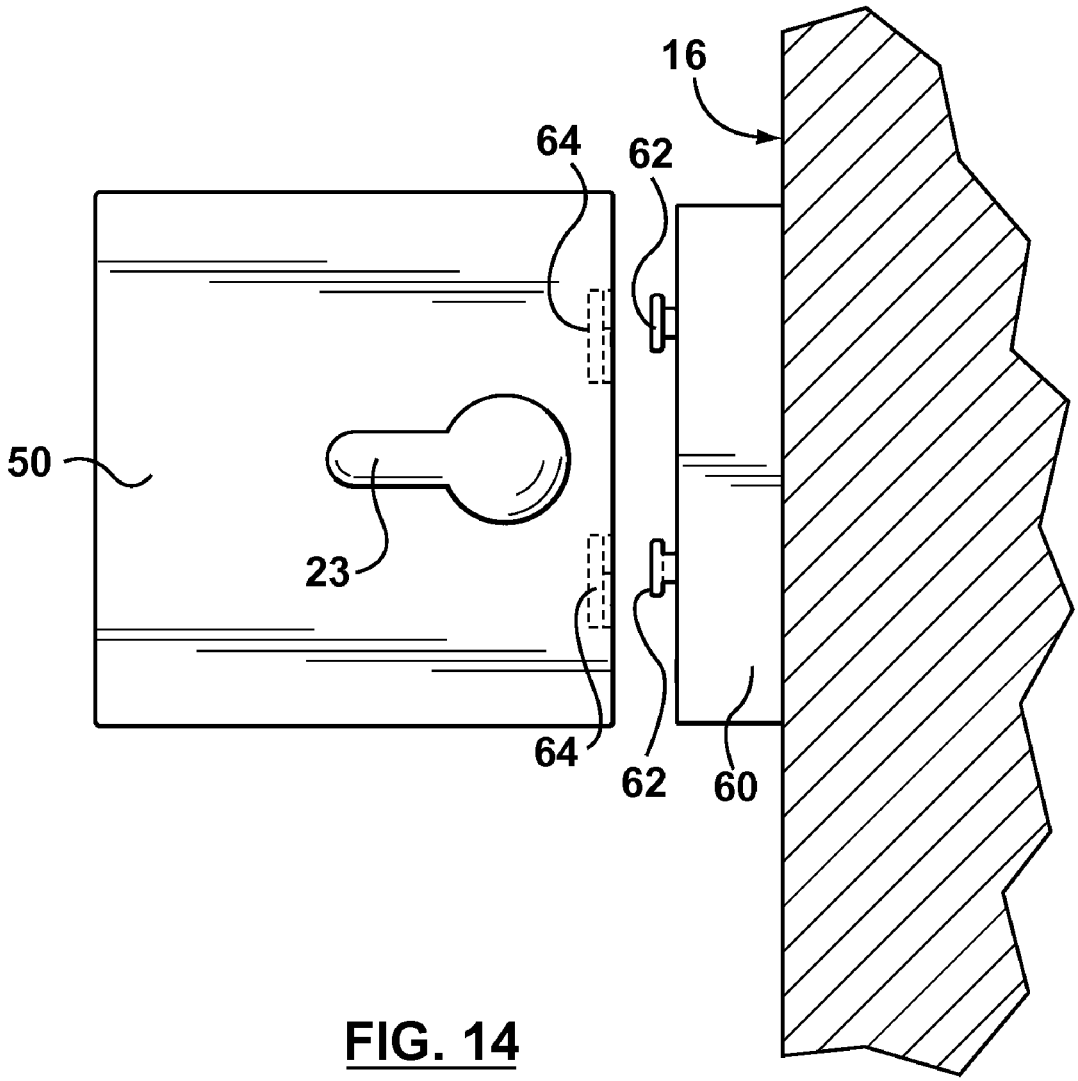
FIG. 14 is a side view of the apparatus of FIG. 1 showing details of mounting the frame to the mounting surface.

In some embodiments, the frame 14 may be mounted to the mounting surface 16 using brackets or other suitable mounting apparatus. For example, as shown in FIGS. 13 and 14, bracket portions 60 may be secured to the mounting surface 16 above the opening 12. Once the portions 60 are secured, the garage door apparatus 10 may be lifted in place above the opening 12 and secured above the opening by engaging locking tabs 62 that extend outwardly from the bracket portions 60 with corresponding slots 64 in the frame members 50.

With the door panels 24 provided in the fully-retracted position, the door panels 24 will tend not to interfere with the engagement between the tabs 62 and the slots 64. Once the garage door apparatus 10 is mounted above the opening 12, the door panels 24 can be lowered into place and engaged with the guide wheels 48.

In some embodiments, with the door panels 24 in the fully-retracted position, the door panels 24 may be coupled to the frame 14 such that the door panels 24 are secured in place and will not unwind from the winding frames 20, forming a secure rectangular "box". This shape tends to be convenient for shipping of the garage door apparatus 10, and may provide a useful transportation container usable to transport other components therein. For example, the transportation container formed by the door panels 24 and the frame 14 may be used to store the driver 23 and the guide channels 34 therein.

In some embodiments, pins or other fastening devices may be used to secure the frame members 50 to the winding frames 20 to inhibit relative rotation thereof during movement and/or transportation of the frame 14.

In some embodiments, one or more of the transverse frame members 50, winding frames 20 and door panels 24 may include one or more openings or removable portions 58 for allowing access to the interior of the apparatus 10 when the door panels 24 are formed into a transportation container, allowing access to components inside the transportation container.

As shown in FIG. 4, the frame 14 is generally mounted to the wall 16 with the winding frames 20 offset from the wall or mounting surface 16 by an offset distance S. The offset distance S is selected such that the door panels 24 will tend not interfere with the wall 16 during rotation of the winding frames 20.

Due to the offset distance S, each the door panels 24 is generally disposed at an acute angle 46 as it engages with and is wound onto the winding frames 20. The offset distance S may be selected to be as small as possible so that the acute angle 46 is minimized.

Figure 15:
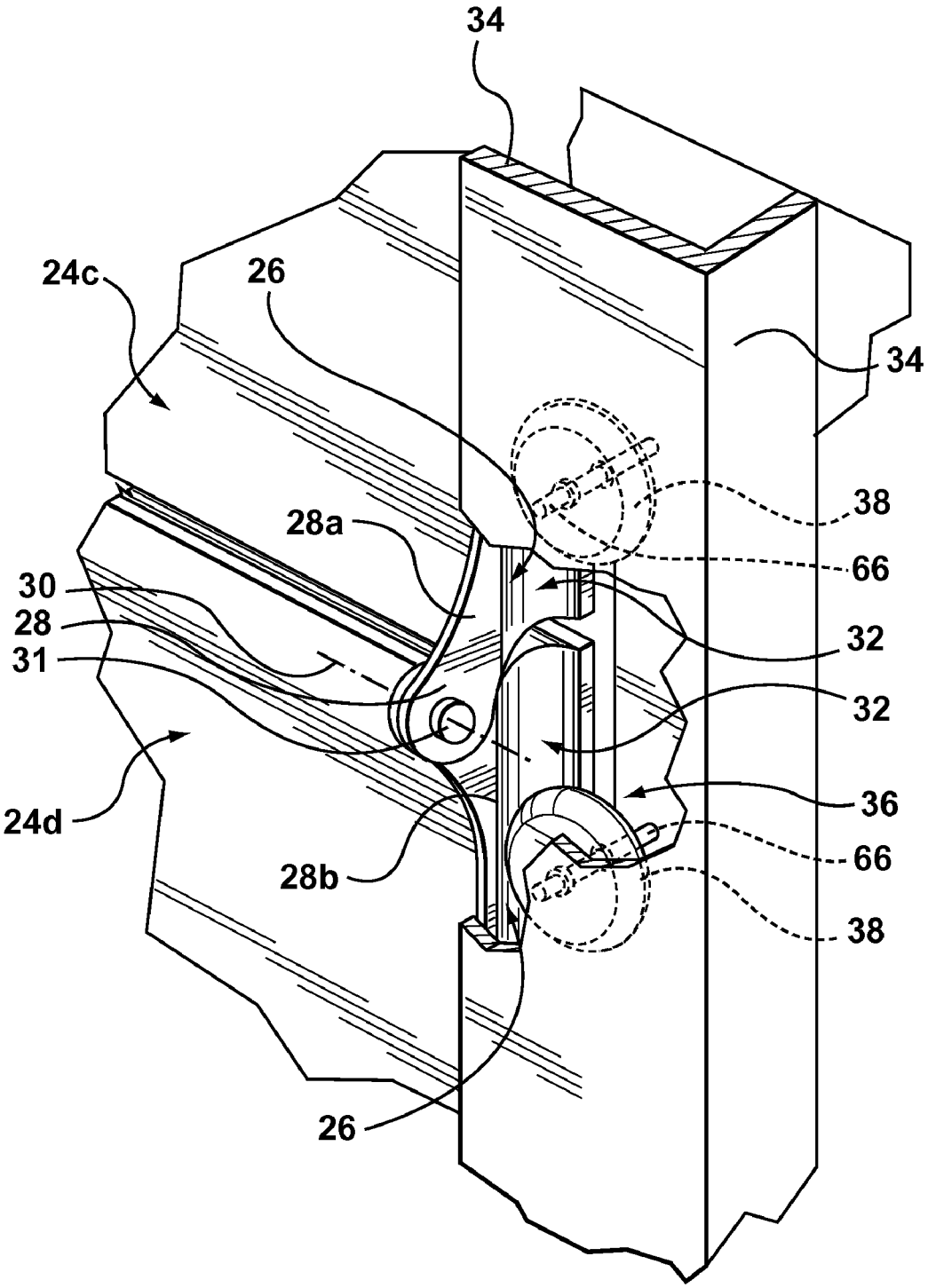
FIG. 15 is a perspective view of a guide channel assembly for use with a garage door apparatus according to another embodiment.

Turning now to FIGS. 15 to 18, according to some embodiments of the invention, each door panel 24 may be hingedly connected to each other by hinges 28 mounted to side panel edges 26, instead of conventional hinges 27 mounted to interior surfaces of the door panels 24. For example, as shown in FIG. 15, the adjacent third door panel 24*c* and fourth door panel 24*d* may be hingedly coupled together via hinge 28 having a first hinge portion 28*a* and a second hinge portion 28*b*, jointed at a common pivot axis 30 using a hinge pin 31. The hinges 28 allow the door panels 24 to flexibly move with respect to one another and to be wound onto the winding frames 20 as the door panels 24 are moved between the extended position and the retracted position.

Figure 17:
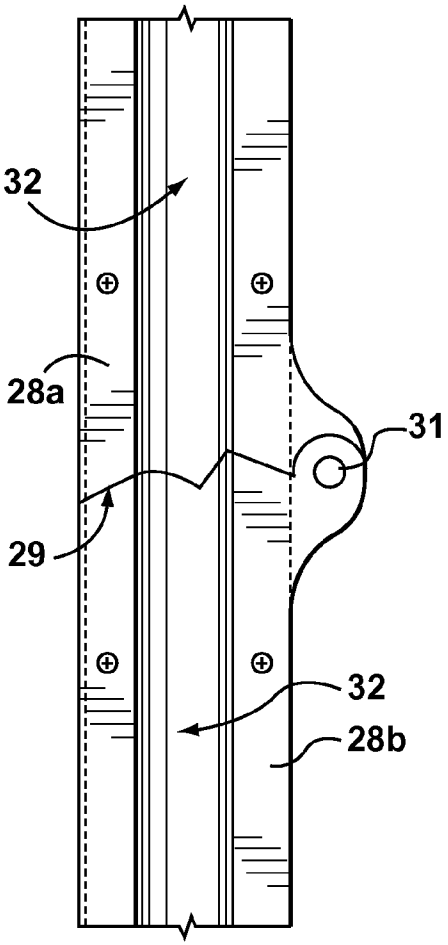
FIG. 17 is a side view of a hinge for use with the garage door apparatus of FIG. 15.

As shown in FIG. 17, the ends of the hinges 28 and/or the panels 24 may have corresponding irregular profiles 29. The shape of the profiles 29 may tend to inhibit water from flowing between adjacent panels 24.

Figure 18:
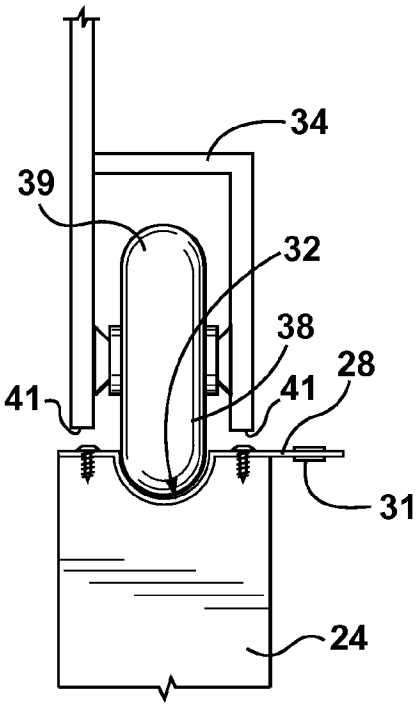
FIG. 18 is a top view of the hinge of FIG. 17 engaged with the guide channel assembly of FIG. 15.
Figure 16:
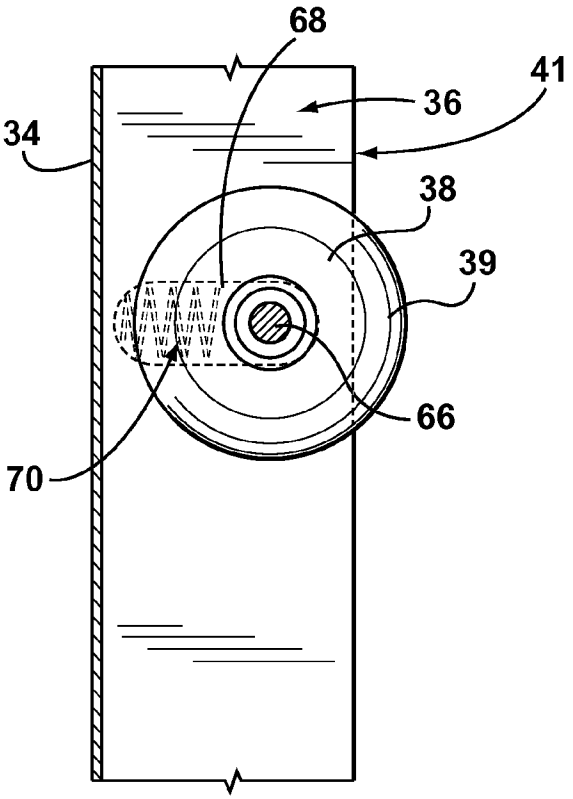
FIG. 16 is a side view of the guide channel assembly of FIG. 15.

In some embodiments, each hinge member 28 and panel side edge 26 may have a concave groove 32 defined therein that generally runs along the length of the hinge 28 and the panel side edge 26 (as shown in FIGS. 17 and 18). The wheels or rollers 38 may be transversely mounted within the guide channels 34 such that a portion 39 of the each roller 38 protrudes beyond a leading edge 41 of the guide channels 34 (as shown in FIGS. 16 and 18). In this manner, the protruding portion 39 of each roller tends to engage with the grooves 32 in the hinges 28 and panel side edges 26 as the door panels 24 move between the extended position and the retracted position, and keep the door panels 24 properly aligned with respect to the guide channels 34 (as shown in FIG. 18).

In some embodiments, the rollers 38 may be configured to apply a biasing force against the grooves 32. For example, the rollers 38 may be mounted on pins 66 that are movably received within slots 68 in the guide channels 34, and the pins 66 may be spring-loaded, for example via a spring 70.

Turning now to FIGS. 19 to 22, in some embodiments, a garage door apparatus 80 may include at least at least five door panels, with a number of inner door panels 82 and at least one outer door panel 84 configured to overlap at least one of the inner door panels 82. For example, the garage door apparatus 80 as shown has eight door panels, including four inner door panels 82*a*, 82*b*, 82*c*, and 82*d* (generally similar to door panels 24*a*, 24*b*, 24*c*, and 24*d* as described above), and four outer door panels 84*a*, 84*b*, 84*c* and 84*d*. The inner door panels 82 are hingedly coupled together, with the first inner door panel 82*a* connected to the second inner door panel 82*b*, the second panel connected to the third panel 82*c*, and so on. Similarly, the outer door panels 84 are hingedly coupled together, with the first outer door panel 84*a* connected to the second outer door panel 84*b*, and so on. To couple the inner door panels 82 to the outer door panels 84, the fourth inner door panel 82*d* is hingedly coupled to the first outer door panel 84*a*.

When the garage door apparatus 80 is in the retracted position, the inner door panels 82 generally engage the first four edges 22 of the winding frames 20, similar to as generally described above, and each of the outer door panels 84 overlaps with one of the inner door panels 82. For example, as shown in FIG. 19, the first outer door panel 84*a* overlaps with the first inner door panel 82*a*, the second outer door panel 84*b* overlaps with the second inner door panel 82*b*, the third outer door panel 82*c* overlaps with the third inner door panel 82*c* and the fourth outer door panel 84*d* overlaps with the fourth inner door panel 82*d*.

It is generally desirable in some embodiments that the inner door panels 82 and outer door panels 84 have substantially the same dimensions, particularly the door widths W. This may be desirable to provide for an improved aesthetic appearance when the inner door panels 82 and outer door panels 84 are in the fully extended position, and furthermore may simplify the manufacturing of the inner door panels 82 and outer door panels 84. To accommodate this, the inner door panels 82 and outer door panels 84 may be configured to accommodate this overlap. For example, the inner door panels 82 may be hingedly coupled together using inner hinges 86, while the outer door panels 84 may be hingedly coupled together using outer hinges 88.

The inner hinges 86 are generally similar to the hinges 28 described above. The outer hinges 88, however, are configured to generally extend and overlap with the inner hinges 86 when the outer door panels 88 are in an overlapping position with the inner door panels 82, such that each outer hinge 88 shares a common pivot axis 89 with one of the inner hinges 86.

Figure 19:
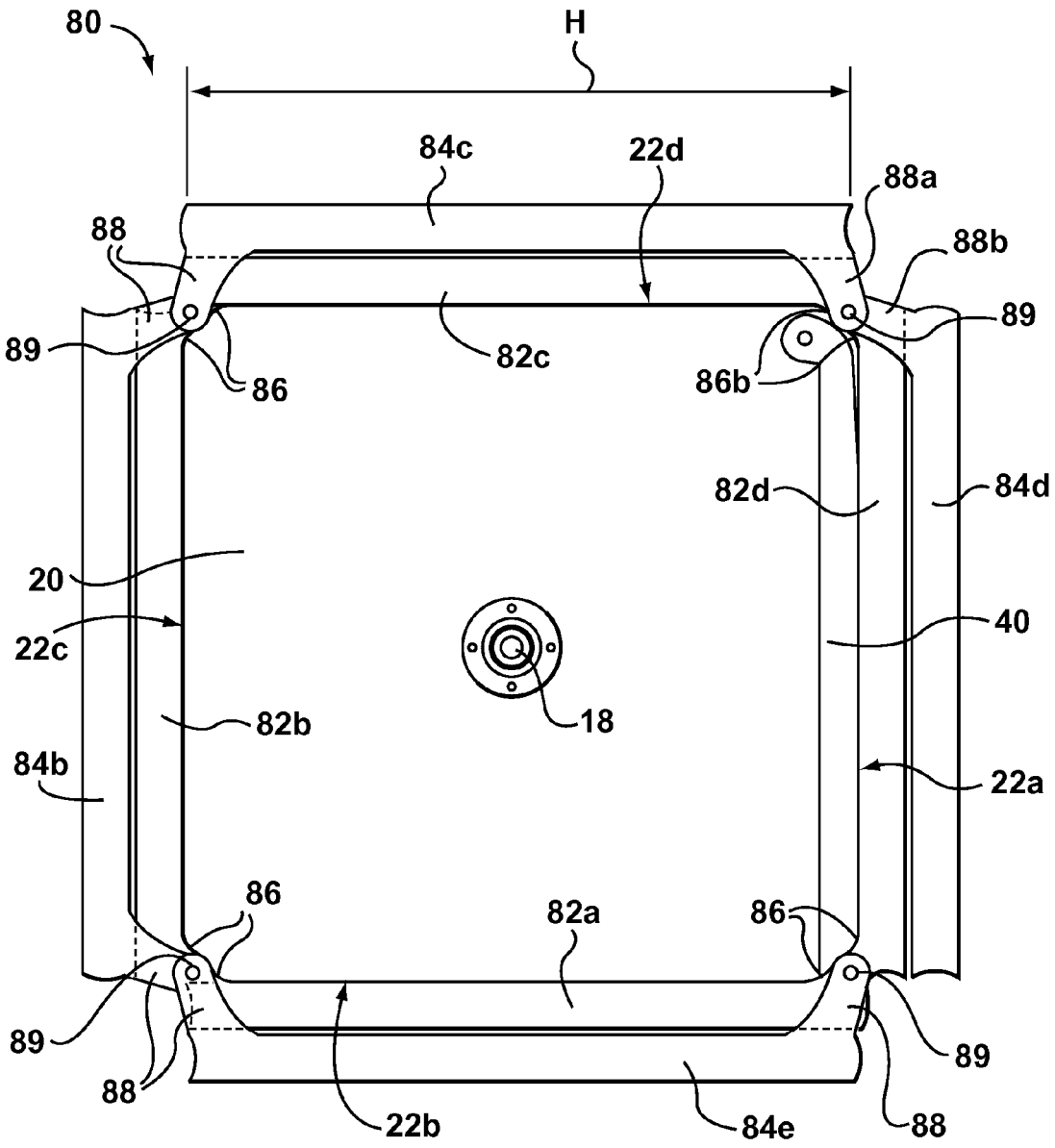
FIG. 19 is a schematic end view of a garage door apparatus with outer door panels overlapping inner door panels according to another embodiment.
Figure 20:
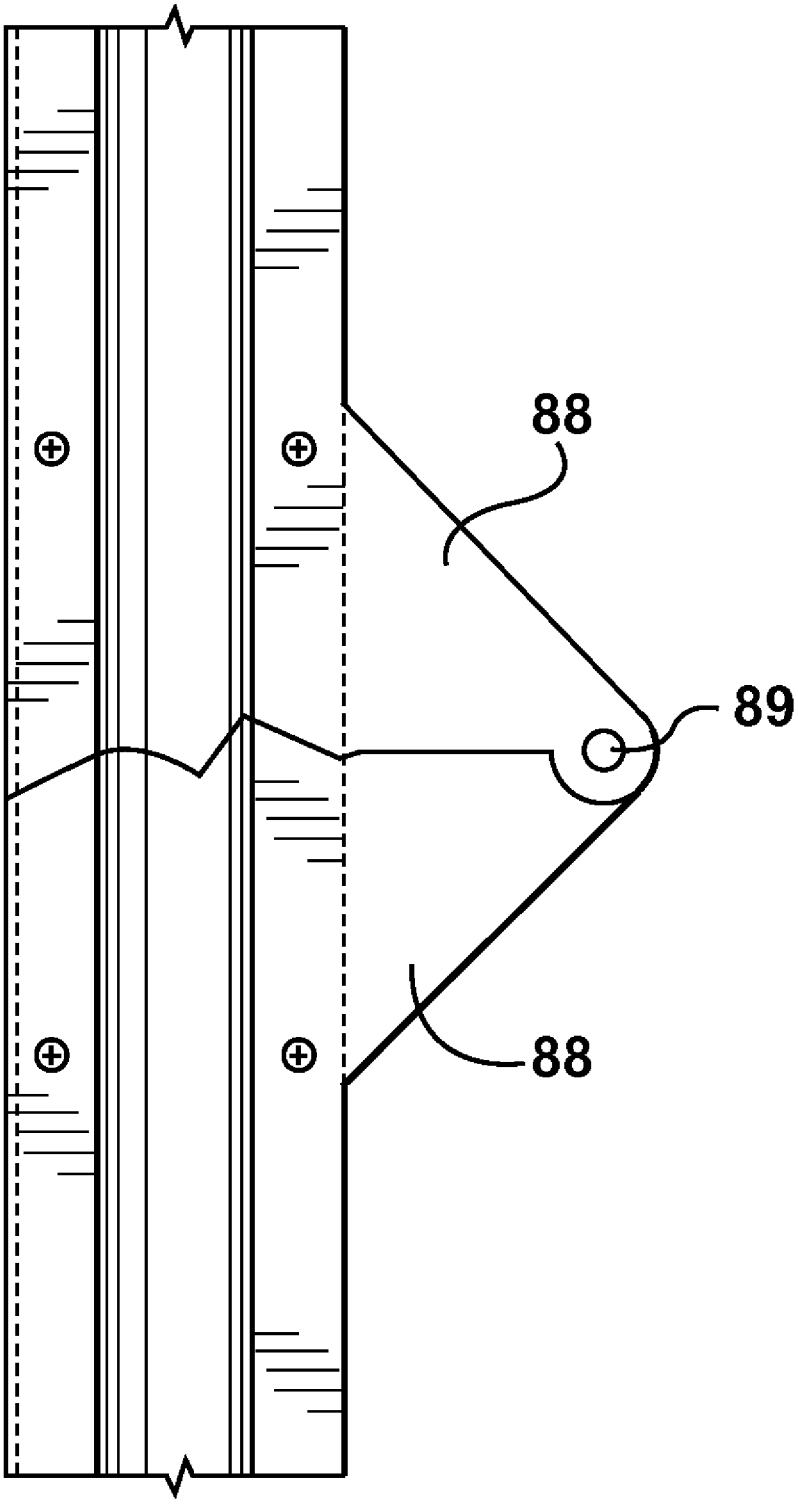
FIG. 20 is an elevation view of an outer hinge for use with the apparatus of FIG. 19.
Figure 21:
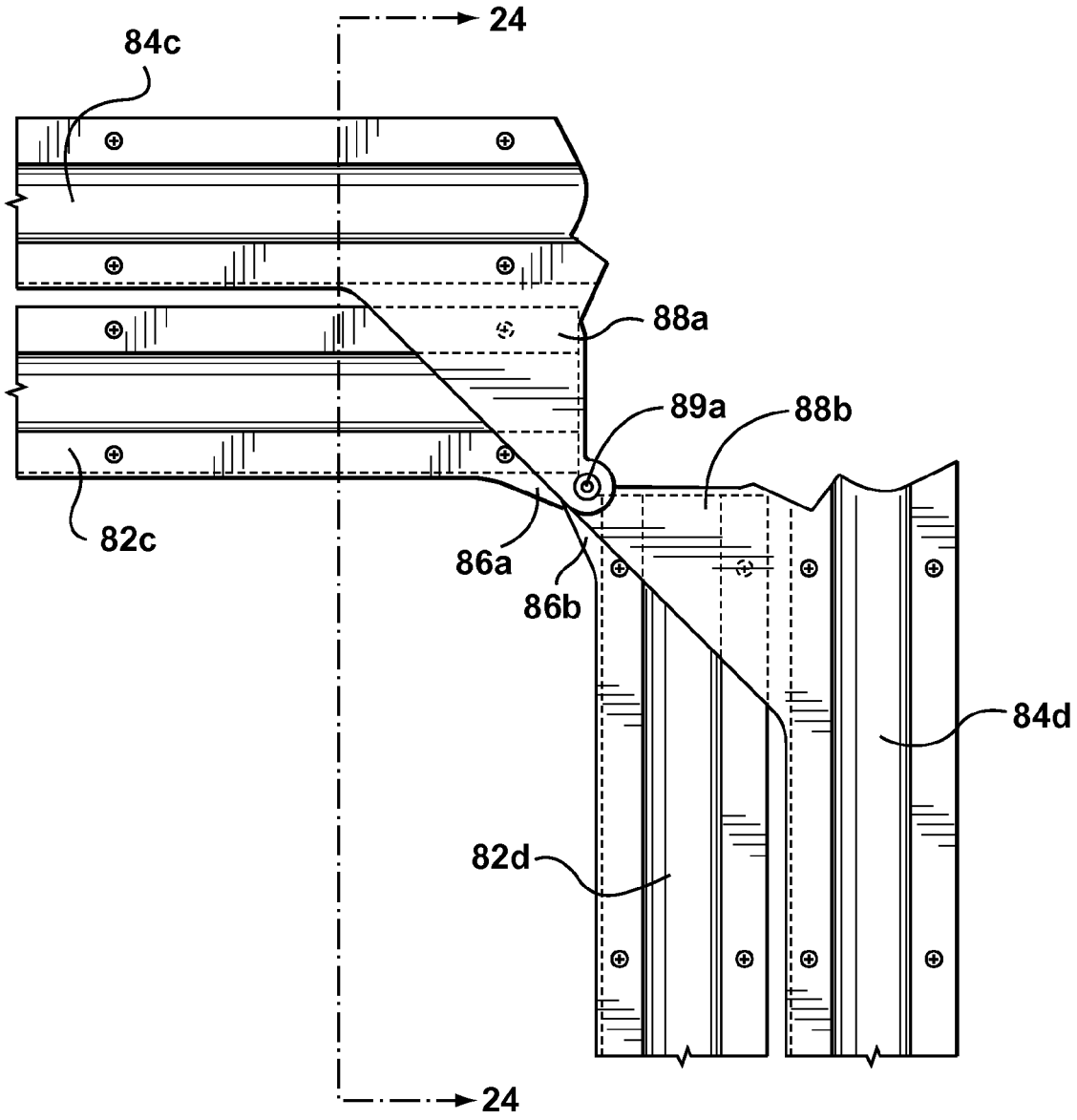
FIG. 21 is a end view of an outer hinge overlapping an inner hinge for the apparatus of FIG. 19.
Figure 22:
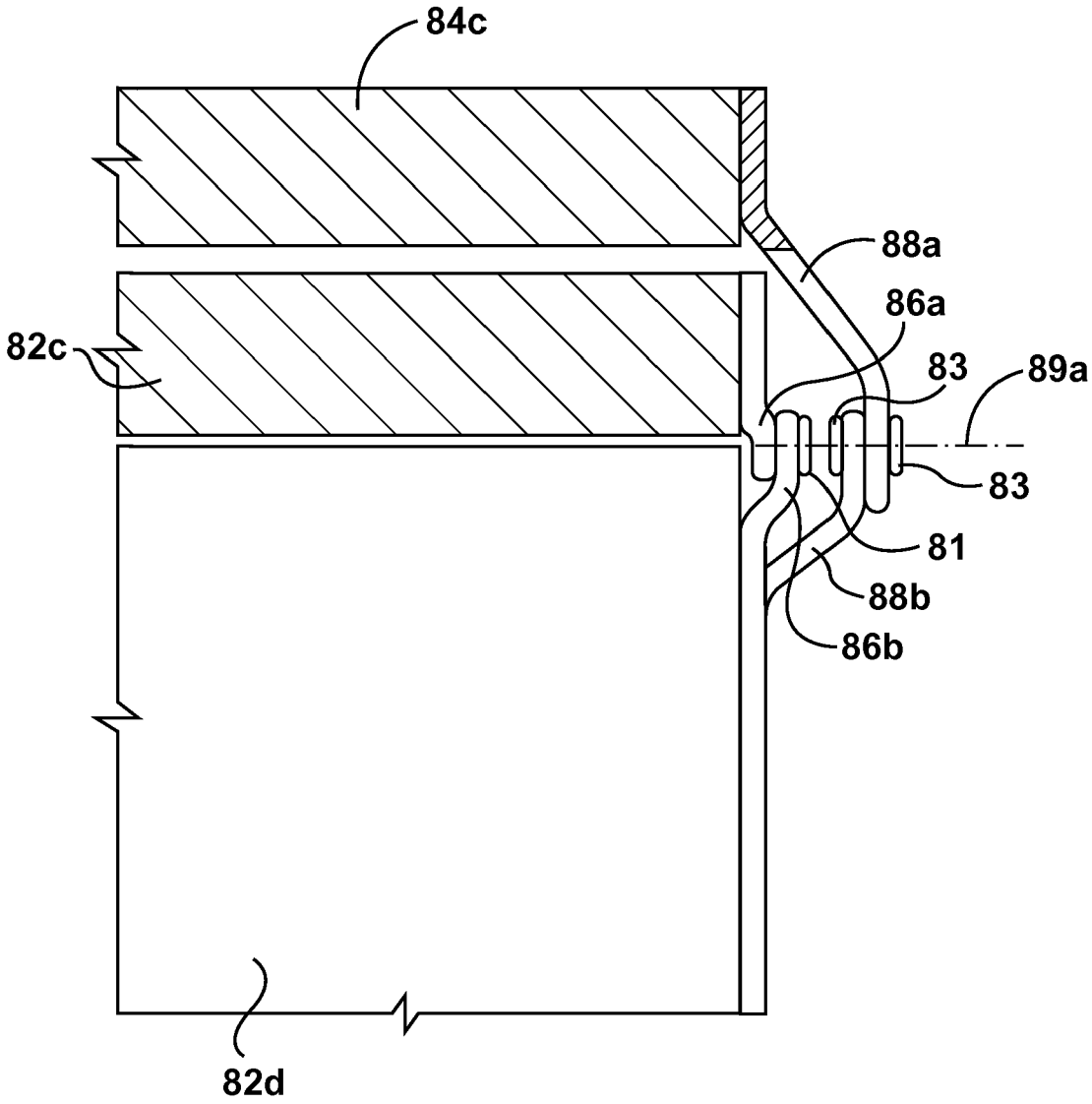
FIG. 22 is a cross sectional view of the outer hinge and inner hinge of FIG. 21 taken along line 24-24.

For example, as shown in FIGS. 19, 21 and 22, the third inner door panel 82*c* has a first inner hinge portion 86*a* mounted thereto, the first inner hinge portion 86*a* being coupled to a second inner hinge portion 86*b* mounted to the fourth inner door panel 82*d*. The first inner hinge portion 86*a* and second inner hinge portion 86*b* are coupled together via a first hinge pin 81, and are pivotable with respect to each other about a first pivot axis 89*a*.

Similarly, the third outer door panel 84*c* has mounted thereto a first outer hinge portion 88*a*, which is in turn coupled to a second outer hinge portion 88*b* mounted to the fourth outer door panel 84*d*. The first and second outer hinge portions 88*a*, 88*b* are pivotably coupled by an outer hinge pin 83 and pivot about the same pivot axis 89*a* as the inner hinge members 86*a*, 86*b*.

As shown in FIG. 22, the first and second outer hinge portions 88*a*, 88*b* may be longitudinally offset from the inner hinge portions 86*a*, 86*b* such that the inner hinges 86 and outer hinges 88 do not interfere with each other as the inner door panels 82 and outer door panels 84 are moved between the extended position and the retracted position.

Figure 23:
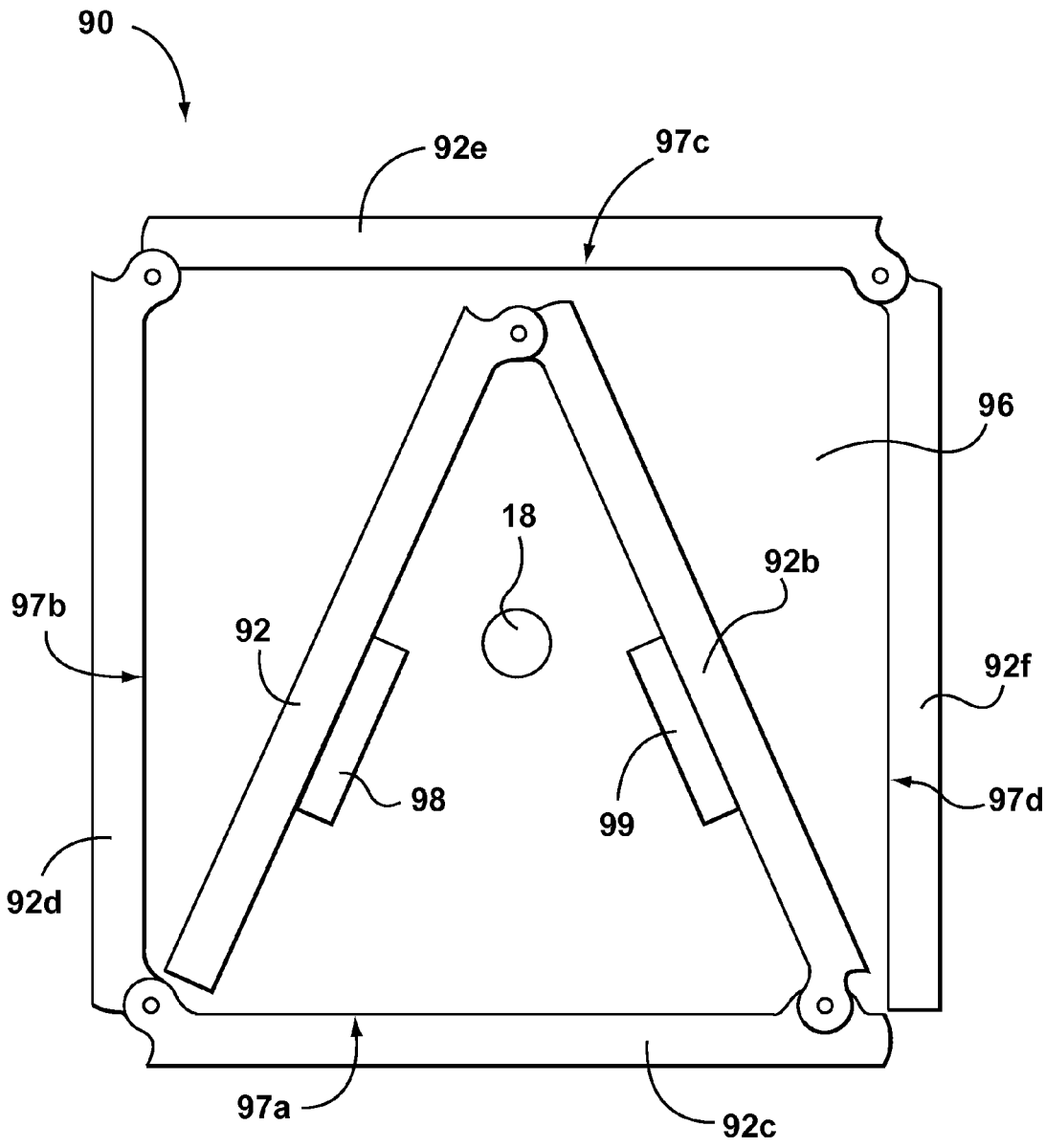
FIG. 23 is a schematic end view of a garage door apparatus according to another embodiment.

Turning now to FIG. 23, a garage door apparatus 90 according to yet another alternative embodiment of the invention is shown. The garage door apparatus 90 includes a first door panel 92*a* and second door panel 92*b*, coupled to third, fourth, fifth and sixth door panels 92*c*, 92*d*, 92*e*, 92*f*. The apparatus 90 also includes spaced winding frames 96 coupled to a shaft 95 similar to the winding frames 20 and shaft 18 described above. The winding frames 96 have side edges 97*a*, 97*b*, 97*c*, and 97*d*, and also include first and second angled flanges 98, 99 mounted thereto.

The first door panel 92*a* and second door panel 92*b* which have a short panel length L2 that is less than the distance D between the spaced winding frames 96, while the other door panels 92*c*, 92*d*, 92*e*, 92*f* have a panel length L that is greater that the distance D between the spaced winding frames 96. Similar to as above, as the winding frames 96 are rotated by the shaft 95, the side edges 97 of the winding frames 96 progressively engage each of the door panels 92, thereby moving the door panels 92 between an extended position wherein the door panels obstruct the opening, and a retracted position wherein the opening is at least partially unobstructed.

As this happens, however, the short panel length L2 of the first door panel 92*a* and second door panel 92*b* being less that the distance D between the winding frames 96, the first door panel 92*a* and second door panel 92*b* will not engage the winding frames 96, but rather will come to rest against the first angled flange 98 and the second angled flange 99, respectively. The third through sixth panels 92*c*, 92*d*, 92*e*, and 92*f*, will then be wound onto the edges 97*a*, 97*b*, 97*c*, and 97*d* of the winding frame 96 similar to as generally described above, encapsulating the first and second panels 92*a*, 92*b* therein.

Figure 24:
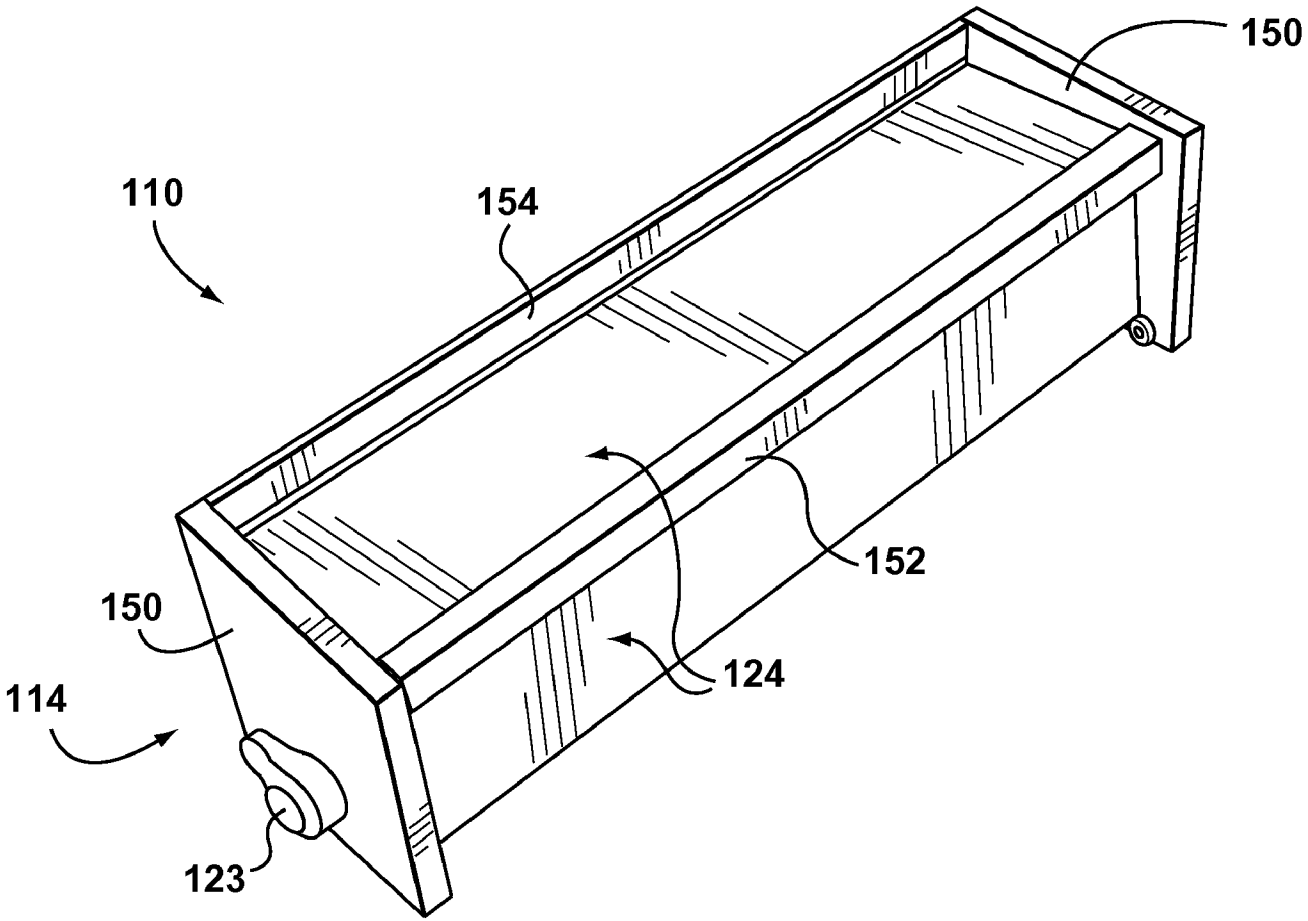
FIG. 24 is a perspective view of a garage door apparatus according to yet another embodiment.
Figure 25:
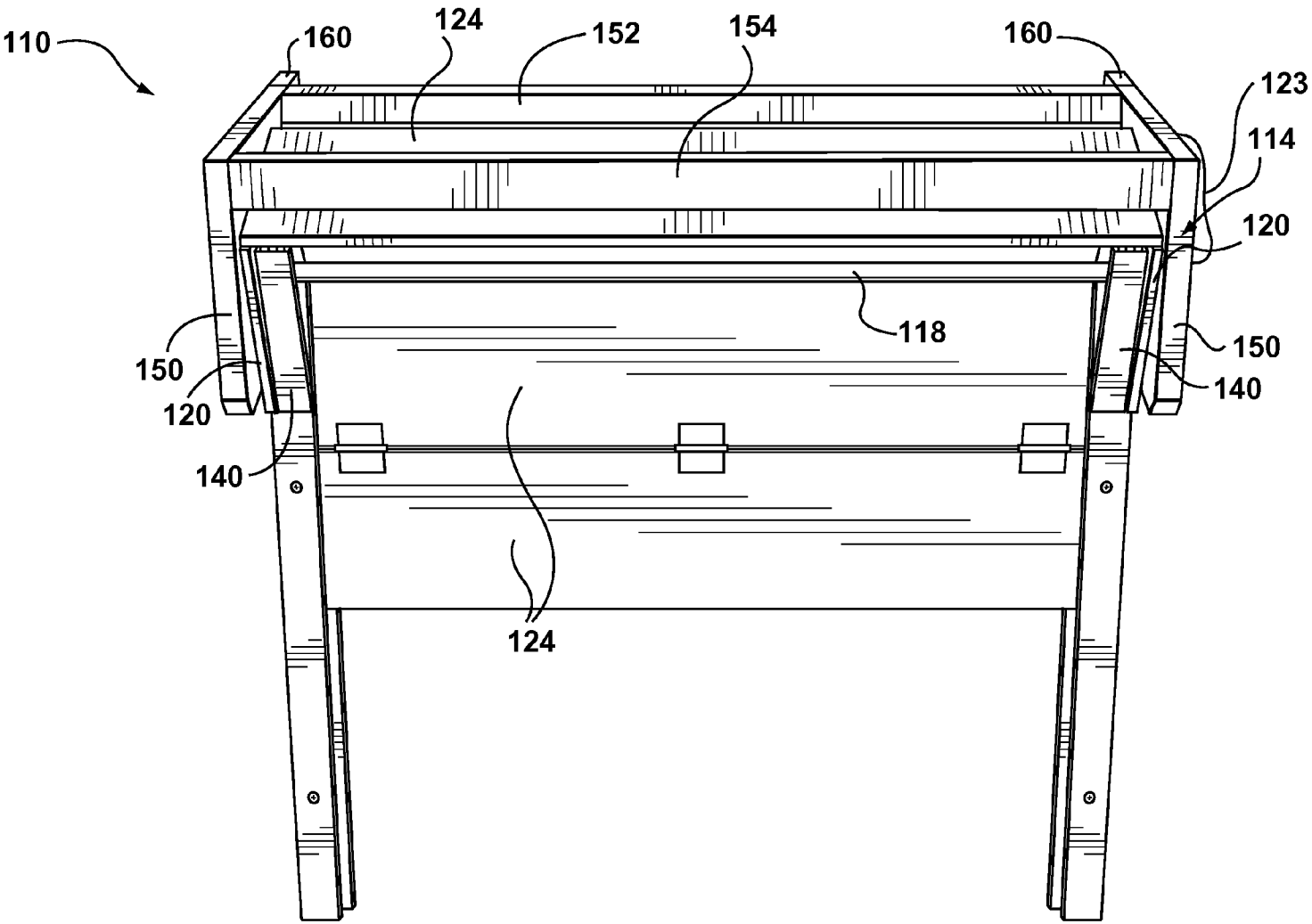
FIG. 25 is a rear perspective view of the garage door apparatus of FIG. 24.

Referring now to FIGS. 24 and 25, illustrated therein is a garage door apparatus 110 according to yet another embodiment of the invention. The apparatus 110 generally includes a frame 114 having a pair of spaced transverse frame members 150 and longitudinal cross members 152, 154 that extend between the frame members 150. The apparatus 110 also includes a shaft 118 rotatably coupled to the transverse frame members 150, a pair of spaced winding frames 120 rigidly coupled to the shaft 118 and positioned in between the spaced frame members 150, a driver 123 coupled to the shaft 118 for rotating the shaft 118 and the winding frames 120, and a plurality of elongate door panels 124 hinged together and linked to the spaced winding frames 120.

As shown, the front cross member 152 and rear cross member 154 join the two spaced transverse frame members 150 together, giving the frame 114 a box-like shape. The cross members 152, 154 of the frame 114 are positioned on the frame members 150 with respect to the winding frames 120 so as not to interfere with the movement of the door panels 124 as the winding frames 120 are rotated. The frame 114 may be mounted above an opening using brackets 160.

While the above description provides examples of one or more articles, methods, and apparatuses, it will be appreciated that other articles, methods, and apparatuses may be within the scope of the present description as interpreted by one of skill in the art.

The invention claimed is:

1. A garage door apparatus, comprising:

a) a frame for mounting above an opening, the frame comprising a pair of spaced transverse frame members;

b) a shaft rotatably coupled to the transverse frame members and extending along a longitudinal axis of rotation between the transverse frame members;

c) a pair of spaced winding frames rigidly coupled to the shaft between the spaced transverse frame members, each of the winding frames having a plurality of side edges;

d) a driver couplable to the shaft for rotating the shaft with respect to the transverse frame members;

e) a plurality of elongate door panels hingedly coupled together and linked to the winding frames, each of the door panels being of equal width and having a longitudinal panel length, and each of the door panels having opposing panel side edges and hinges provided on the panel side edges for coupling with hinges on an adjacent door panel, each of the hinges and panel side edges having a groove therein; and f) a pair of guide channel assemblies for mounting adjacent opposite vertical sides of the opening, each guide channel assembly including rollers transversely mounted therein, the rollers sized and shaped for engaging with the grooves in the hinges and side edges as the door panels move between an extended position and a retracted position; and g) wherein the winding frames are spaced apart a predetermined distance that is less than the panel length of the plurality of door panels, such that when the winding frames are rotated by the driver about the axis of rotation, the side edges of the winding frames progressively engage each of the door panels thereby moving the door panels between the extended position wherein the door panels obstruct the opening, and the retracted position wherein each door panel is wound onto one of the side edges of the winding frames and the opening is at least partially unobstructed.

2. The apparatus of claim 1, wherein the plurality of door panels includes at least four door panels of equal width, and each of the winding frames has a square shape having four side edges.

3. The apparatus of claim 1, wherein the door panels and frame are configured so that the door panels form the sides of a transportation container when the door panels are in the retracted state.

4. The apparatus of claim 1 wherein each frame member has a bracket for mounting to a mounting surface above the opening.

5. The apparatus of claim 1 wherein:

a) the door panels comprise a plurality of inner door panels and at least one outer door panel;

b) the hinges comprise inner hinges on the inner door panels and outer hinges on the outer door panels; and c) when the door panels are in the retracted position, each outer door panel overlaps with one inner door panel, and at least one of the inner hinges of the inner door panels have a common pivot axis with the outer hinges of the corresponding overlapping outer door panel when the door panels are in the retracted position.

6. The apparatus of claim 5, wherein the outer hinges are longitudinally spaced from the inner hinges to inhibit interference between the inner hinges and the outer hinges as the door panels move between the extended position and the retracted position.

7. The apparatus of claim 1, further comprising at least one longitudinal cross member extending between the transverse frame members.

8. The apparatus of claim 7, wherein the at least one longitudinal cross member includes a front cross member and a rear cross member.

9. A garage door apparatus, comprising:

a) a frame for mounting above an opening, the frame comprising a pair of spaced transverse frame members and at least one longitudinal cross member extending between the transverse frame members;

b a shaft rotatably coupled to the transverse frame members and extending along a longitudinal axis of rotation between the transverse frame members;

c) a pair of spaced winding frames rigidly coupled to the shaft between the spaced transverse frame members, each of the winding frames having a plurality of side edges;

d) a driver couplable to the shaft for rotating the shaft with respect to the transverse frame members; and e) a plurality of elongate door panels hingedly coupled together, each of the door panels having a longitudinal panel length, the plurality of door panels including a first door panel linked to the winding frames;

f) wherein the winding frames are spaced apart a predetermined distance that is less than the panel length such that when the winding frames are rotated about the axis of rotation, the side edges of the winding frames progressively engage each of the door panels thereby moving the door panels between an extended position wherein the door panels obstruct the opening, and a retracted position wherein each door panel is wound onto one of the side edges of the winding frames and the opening is at least partially unobstructed;

g) further comprising a pair of guide channels configured to be mounted along vertical sides adjacent the opening for guiding the door panels as they move between the extended position and the retracted position;

h) wherein each door panel comprises opposing panel side edges, and further comprising rollers mounted within the channel guides the rollers sized and shared for e a in with the panel side edges as the door panels move between the extended position and the retracted position; and i) wherein the door panels are hingedly coupled together by hinges provided on the panel side edges, the hinges and panel side edges having grooves therein, and the rollers are transversely mounted within the channel guides and configured to engage with the grooves as the door panels move between the extended position and the retracted position.

10. The apparatus of claim 9, wherein the plurality of door panels includes at least four door panels of equal width, and each of the winding frames has a square shape having four side edges.

11. The apparatus of claim 9, wherein, the door panels and frame are configured so that the door panels form the sides of a transportation container when the door panels are in the retracted state.

12. The apparatus of claim 9, wherein the at least one longitudinal cross member includes a front cross member and a rear cross member.

13. The apparatus of claim 9 wherein each frame member has a bracket for mounting to a mounting surface above the opening.

14. The apparatus of claim 9, wherein:

a) the door panels comprise a plurality of inner door panels and at least one outer door panel, each door panel having panel side edges; and b) the door panels are hingedly coupled together by inner hinges provided on the panel side edges of the inner door panels, and outer hinges provided on the panel side edges of the outer door panels;

c) wherein, when the door panels are in the fully retracted position, each outer door panel overlaps with one inner door panel, with at least one of the inner hinges of the inner door panels having a common pivot axis with one of the outer hinges of the corresponding overlapping outer door panel.

15. The apparatus of claim 14, wherein the outer hinges are longitudinally spaced from the inner hinges to inhibit interference between the inner hinges and the outer hinges when the door panels move between the extended position and the retracted position.

* * * * *